US011590405B2

(12) United States Patent
Altshuler

(10) Patent No.: US 11,590,405 B2
(45) Date of Patent: Feb. 28, 2023

(54) ADJUSTABLE HOCKEY RUNNER ASSEMBLY

(71) Applicant: Edward L. Altshuler, Dacono, CO (US)

(72) Inventor: Edward L. Altshuler, Dacono, CO (US)

( * ) Notice: Subject to any disclaimer, the term of this patent is extended or adjusted under 35 U.S.C. 154(b) by 0 days.

(21) Appl. No.: 17/500,876

(22) Filed: Oct. 13, 2021

(65) Prior Publication Data

US 2022/0062741 A1 Mar. 3, 2022

Related U.S. Application Data

(62) Division of application No. 16/581,133, filed on Sep. 24, 2019, now Pat. No. 11,420,106.

(51) Int. Cl.
*A63C 1/32* (2006.01)
*A63C 1/30* (2006.01)

(52) U.S. Cl.
CPC ..... *A63C 1/303* (2013.01); *A63C 1/32* (2013.01)

(58) Field of Classification Search
CPC .. A63C 1/303; A63C 1/32; A63C 1/40; A63C 1/30; A63C 1/34; A63C 1/36
See application file for complete search history.

(56) References Cited

U.S. PATENT DOCUMENTS

| | | | | |
|---|---|---|---|---|
| 3,339,935 | A | 9/1967 | Weisman | |
| 6,485,033 | B2 * | 11/2002 | Nicoletti | A63C 1/303 280/11.18 |
| 6,568,710 | B2 * | 5/2003 | Kim | A63C 1/32 280/11.18 |
| 6,669,210 | B2 | 12/2003 | Chen | |
| 7,392,990 | B2 | 7/2008 | Bussiere | |
| 7,533,479 | B2 | 5/2009 | Labonte | |
| 7,562,881 | B2 | 7/2009 | Crowder | |

FOREIGN PATENT DOCUMENTS

| | | | |
|---|---|---|---|
| EP | 3415205 | A1 | 12/2018 |
| GB | 1112246 | A | 1/1968 |
| WO | WO 2008119174 | A1 | 9/2008 |

* cited by examiner

*Primary Examiner* — John D Walters
(74) *Attorney, Agent, or Firm* — Kenneth Altshuler

(57) ABSTRACT

A multi-degree of freedom ice skate post that connects an ice skate blade to the sole of an ice-skating boot generally comprises a plurality of adjustable elements that include a pronate/supinate platform, a bi-directional module and a side/side module. In some configurations, the pronate/supinate platform is configured to move the ice skate blade in a pronate and supinate direction. In some configurations the pronate supinate platform is connected with the bi-directional module providing movement of the ice skate blade in the fore and aft position. In some configurations the side/side module is connected with the bi-directional module providing movement in a side by side direction. Additional configurations can include vertical adjustments as well.

14 Claims, 39 Drawing Sheets

ADJUSTABLE HOCKEY RUNNER ASSEMBLY

CROSS-REFERENCE TO RELATED APPLICATIONS

This application is a Divisional patent application which claims priority to U.S. Non-Provisional patent application Ser. No. 16/581,133 entitled Adjustable Hockey Runner Assembly filed on Sep. 24, 2019, the entire disclosure of which is hereby incorporated by reference.

BACKGROUND OF THE INVENTION

1. Field of the Invention

The present invention relates generally to an ice-skate runner assembly.

2. Description of Related Art

A fundamental interest in the human experience is sport. We will spend our wealth and resources on whatever sport/s piques our interest vying for the latest innovation that could possibly give us a competitive edge. The progression of sport innovations is easily recognized by sports equipment related filings over the years at the United States Patent and Trademark Office. In the field of hockey for example, hockey skates are generally comprised of a boot and steel blade bolted or fixed to the boot sole. Modern hockey skates typically include innovations such as a hard plastic shell that accepts a portion of the skate blade whereby the shell is bolted to the skate blade and may further act as an interface and attachment medium to the boot sole. With that the, the current state of hockey skate technology leaves open lots of problems yet to be solved in the march for the best hockey skate for a given purpose defined by the game.

It is to innovations related to improving hockey blades and runners that the subject matter disclosed herein is generally directed.

SUMMARY OF THE INVENTION

The present invention generally relates to a multiple degree of freedom ice skating post arrangement that is connected to an ice skate at one end and an ice skating boot at the other end.

A skate runner comprising: an elongated skate runner body that extends between a front end and a rear end defining a blade length; a bottom region defining a bottom width and a top region defining a top width; a blade edge located at the bottom region, the blade edge is configured to contact an ice sheet, the blade edge extending in a vertical direction terminating at a blade top; a neutral plane defined along a central axis centrally located in the bottom width in the vertical direction and along the blade length; the top width narrower than the bottom width; and a stress relieving radius that joins the top region to the bottom region, the skate runner is a unitary structure. Certain embodiments envision the top region essentially encased in a polymeric overmold core that extends in the vertical direction beyond the blade top terminating at an overmold core top. The polymeric overmold core can essentially be encased in a skate overmold that is essentially defined by an overmold top surface and overmold side walls which terminates at a blade/overmold interface, the overmold top surface possessing a front mounting surface and a rear mounting surface.

The front mounting surface and a rear mounting surface further possess female interlocking mount receptacles. Certain embodiments envision the female interlocking mount receptacles cooperate with male interlocking mounts or that the female interlocking mount receptacles cooperate with male interlocking mounts that extend from a bottom side of a mounting plate, the mounting plate comprising an arced mounting surface on a top side. The arced mounting plates can possesses pronate/supinate graduated indicia visibly disposed on at least a front surface. Certain embodiments envision the front mounting surface and a rear mounting surface are each removably connected with a mounting plate. Each of the mounting plates possess a convex arc cylinder segment that arcs around a contact axis defined by a rocker high point of the blade edge and the neutral plane.

Certain other embodiments envision a pronate/supinate platform that possesses a concave arc that mates with the convex arc cylinder segment. This can further comprise pronate/supinate graduations visibly located on at least a front surface of the mounting plates that cooperate with a pronate/supinate centerline pointer on the pronate/supinate platform. The pronate/supinate platform is adjustably attached to the convex arc cylinder segment and can rotate about the contact axis in a pronation position or a supination position. The pronate/supinate platform can further comprise fore/aft graduated indicia visibly disposed on at least one pronate/supinate platform side surface below a fore/aft dovetail extending along a top portion of the pronate/supinate platform. The pronate/supinate platform can further comprise a bi-directional locking dovetail module that includes a threaded cylinder, a fore/aft dovetail channel extending from bottom side of the threaded cylinder that slidingly engages the fore/aft dovetail parallel to the contact axis, and a side/side dovetail channel extending from a threaded cylinder top side that extends essentially perpendicular to the contact axis. A threaded ring can be rotatingly engaged with threads on the threaded cylinder. The threaded ring is in a locking position when the threaded ring is in contact compression with the pronate/supinate platform top surface, the fore/aft dove tail is in compression with the fore/aft dovetail channel, the threaded ring is in an unlocking position when the threaded ring is not in the contact compression with the fore/aft dovetail. The fore/aft dovetail can be disconnected from the fore/aft dovetail channel by loosening the threaded ring. A centerline pointer B visibly located on the fore/aft dovetail channel can point to the fore/aft graduated indicia.

Other embodiments further envision a side/side dovetail module that includes a side/side dovetail extending from a bottom side of a threaded cylinder, threaded cylinder possesses threads on the threaded cylinder, the side/side dovetail slidingly engages the side/side dovetail channel that is essentially perpendicular to the contact axis. This can further comprise a threaded ring that is rotatingly engaged with threads on the threaded cylinder. The threaded ring is in a locking position when the threaded ring is in contact compression with the side/side dovetail the side/side dovetail is in compression with the side/side dovetail channel. The threaded ring is in an unlocking position when the threaded ring is not in contact compression with the side/side dovetail. The threaded cylinder possesses at least one lift ring orientation recess that extends into the cylinder surface between the bottom side to a cylinder top surface of the threaded cylinder. A plate is interposed between the side/side dovetail and the bottom cylinder side, the plate defining a plate surface from which the side/side dovetail extends, side/side graduated indicia visibly located on the plate surface, the side/side graduated indicia cooperating with the centerline pointer.

Other embodiments contemplate a lift ring that encircles the threaded cylinder, the lift ring possessing at least one lift ring alignment key that engages the at least one lift ring orientation recess in a limited rotating relationship. The limited rotating relationship provides up to 20° of rotation between the lift ring and the threaded cylinder. The lift ring terminates at a lift ring top surface that when engaged with the threaded cylinder is above the top surface. A threaded ring is rotationally engaged with the threaded cylinder whereby the lift ring rests on the threaded ring. The lift ring can be moved between a high position and a low position on the threaded cylinder. Embodiments envision these components together functionally mounting to the bottom of an ice-skating boot sole.

DETAILED DESCRIPTION

Figure 1A:
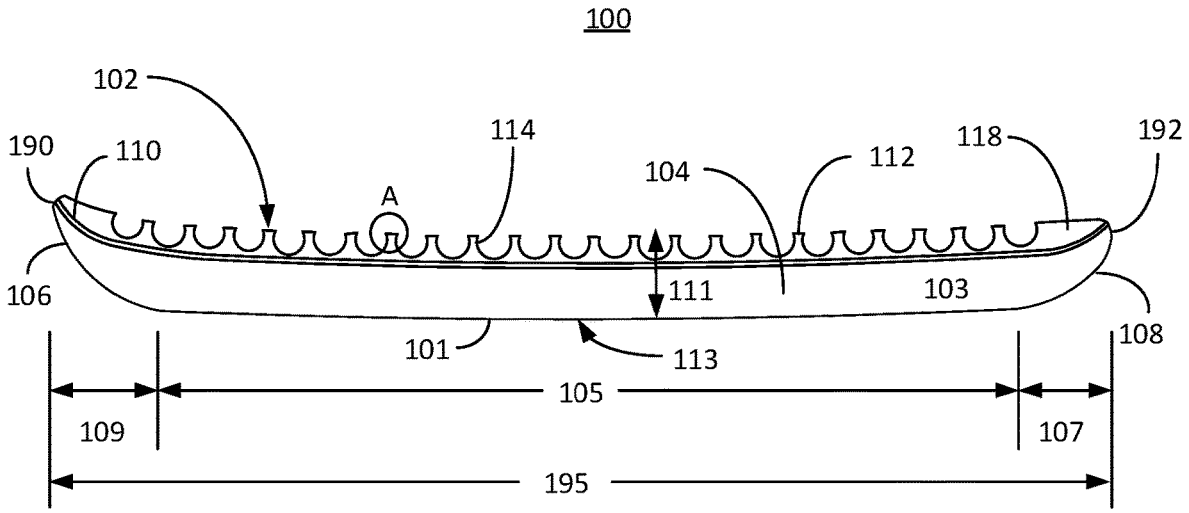
FIGS. 1A-1B illustratively shows a side view and an orthogonal view of a blade runner with a serrated top in accordance with an embodiment of the present invention.

Before proceeding with the detailed description, it is to be appreciated that the present teaching is by way of example only, not by limitation. The concepts herein are not limited to use or application with a specific system or method illustratively described herein using the disclosed blade assembly embodiments. Thus, although the instrumentalities described herein are for the convenience of explanation, shown and described with respect to exemplary embodiments, it will be appreciated that the principles herein may be applied equally in other types of related systems and methods involving adjustable ice-skate structures particularly directed to hockey skates.

Described herein is a multi-degree of freedom ice skate post that connects an ice skate blade to the sole of an ice-skating boot generally which provides advantages of multiple degrees of freedom between the ice skate blade and the ice-skating boot. Certain embodiments comprise a plurality of adjustable elements that include a pronate/supinate platform, a bi-directional module and a side/side module. In some configurations, the pronate/supinate platform is connected with the ice skate blade and is configured to move the ice skate blade in a pronate and supinate direction. In some configurations the pronate supinate platform is connected with the bi-directional module providing movement of the ice skate blade in the fore and aft position. In some configurations the side/side module is connected with the bi-directional module providing movement in a side by side direction. Additional configurations can include vertical adjustments as well.

Referring to the drawings in general, and more specifically to FIGS. 1A-1D, shown therein is an illustration of a skate/blade runner embodiment constructed in accordance with an embodiment of the present invention. In what follows, similar or identical structures may be identified using identical callouts.

FIGS. 1A-1D illustratively depict a skate runner 100 defined by an elongated skate runner body 103 that spans between a front end 190 and a rear end 192, and has a blade height 111 that extends between a bottom region 104 in the top region 118. As shown in conjunction with FIG. 1D, the bottom region 104 defines a bottom width 128 and the top region 118 defines a top width 126 that terminates at a top surface 102. A blade edge 101, which in the present embodiment is concave, is adapted to contact an ice sheet (not shown). The blade edge 101 is located at the distal edge of the bottom region 104. In the present embodiment, the bottom width 128 is wider than the top width 126, which provides a weight reduction. The top region 118 joins the bottom region 104 by way of a stress relieving radius 110. The stress relieving radius 110 inhibits crack formation between the top region 118 and the bottom region 104. Certain embodiments envision the stress relieving radius 110 having a circular curvature. The present embodiment envisions a unitary skate runner 100 made up of stainless steel. Other embodiments envision skate runner made of different materials, such as titanium for example. In the present embodiment, the skate runner 100 has a leading rounded front edge 106 located in the front blade region 109 and trailing rounded rear edge 108 located in a rear blade region 107. Between the front edge 106 and the rear edge 108 is a slightly arced middle region 105. Certain embodiments envision the skate height 111 being between 0.75-2.5 inches, the bottom width 128 being between 1/16 inches and 3/16 inches and the top width 126 being between 1/32 inches and 1/8 inches. Other certain embodiments envision the bottom region 104 having a height that is one-half of the top region 118. Yet other embodiments envision the top region 118 being approximately 1/3 of the overall skate height 111. The front blade region 109, the arced middle blade region 105, and the rear blade region 107 define the overall length 195 of the skate runner 100.

Figure 1B:
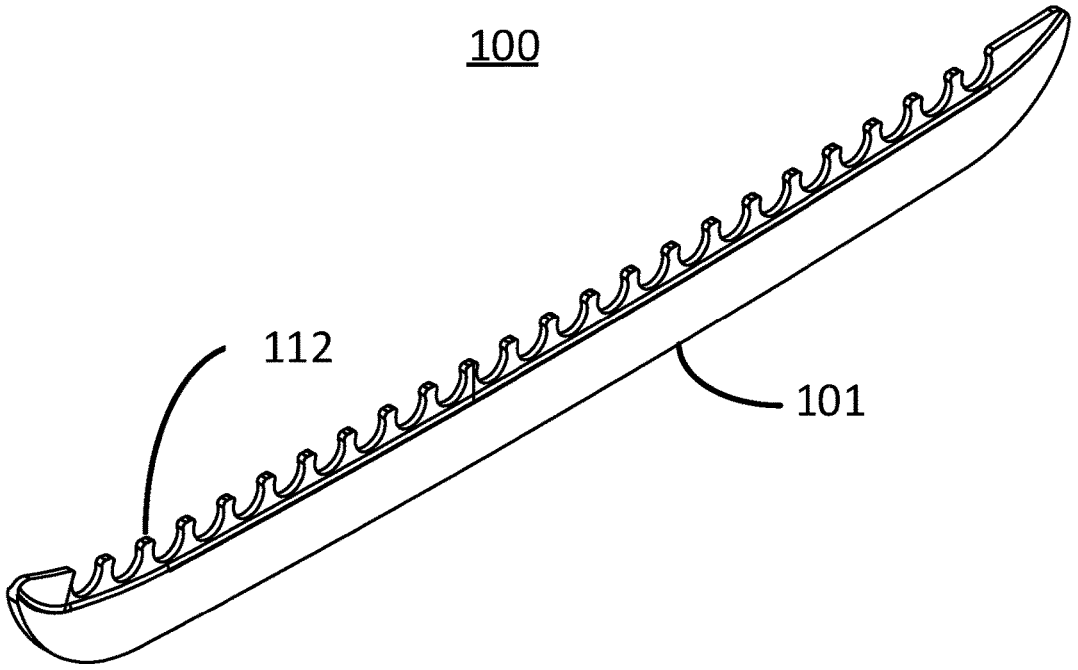
Figure 1C:
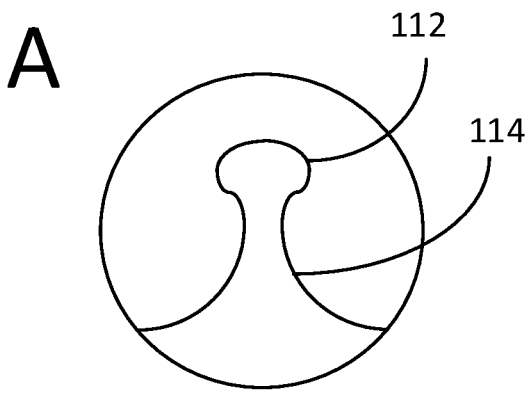
FIG. 1C depicts an enlarged image of a serrated top locking mechanism in accordance with an embodiment of the present invention.
Figure 1D:
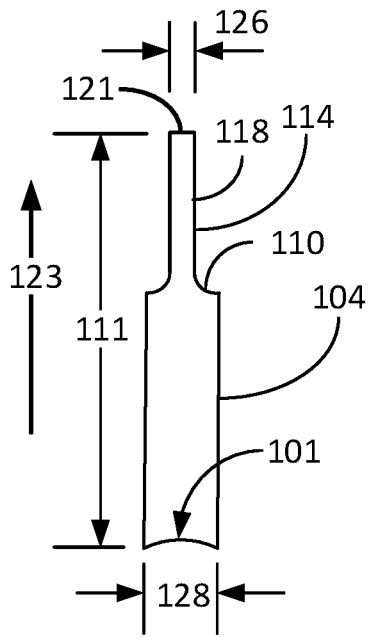
FIG. 1D depicts a front view of a blade runner with a serrated top in accordance with an embodiment of the present invention.

The present embodiment depicts a plurality of serrated protrusions 114 that extend along the top region 118 of the skate runner body 103 to provide a means for fixedly attaching an overmold to the top region 118 also shown by the isometric view of the skate runner 100 in FIG. 1B. As will be discussed infra, certain embodiments envision a skate runner essentially encapsulated by an overmold in the top region 118. The overmold mechanically locks to the top region 118 by infiltrating between the semicircles or other shapes in the top region 118. In this way, these adhesion features 114 provide enhanced shear strength. In the present embodiment, the serrated protrusions 114 are one of many different shapes that can accomplish the task of mechanically locking the top region 118 to in overmold. With special attention FIG. 1A, a single serrated protrusion 114 (of the many serrated protrusions) in the Circle-A is magnified in FIG. 1C. As shown in FIG. 1C, there is a bulbous end 112 at the tip of the single serrated protrusion 114 to improve adhering the overmold with the tip region 118.

Figure 1E:
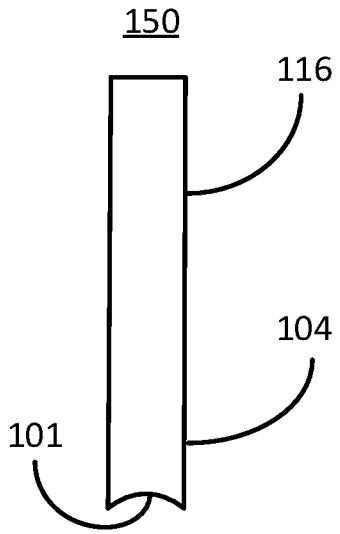
FIGS. 1E and 1F illustratively depict line drawings of several other profile embodiments of a skate runner cross-section consistent with embodiments of the present invention.
Figure 1F:
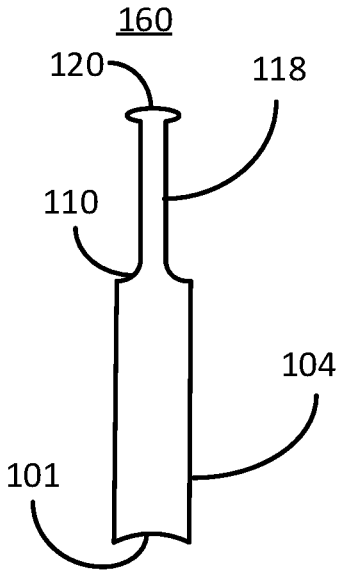

FIGS. 1E and 1F illustratively depict line drawings of several other profile embodiments of a skate runner cross-section consistent with embodiments of the present invention. With reference to FIG. 1E, a skate runner 150 possesses a skate runner body 116 that is essentially a uniform width, which in certain embodiments can have overmold adhesion features such as holes/perforations, countersinks, counterbores, serrations, undercuts extending into the top region 118 or other shear strength enhancing arrangements, (see FIG. 1F). FIG. 1F depicts an optional skate runner embodiment 160 that illustratively shows a thinner top region 118 to accommodate a reduced weight runner blade with a lip 120 that runs at least along a portion of the top edge of the top region to lock the blade's upper region to an overmold. Though embodiments of the present invention envision a top region devoid of adhesion features within overmold, such a configuration may have adhesion disadvantages.

Figure 1G:
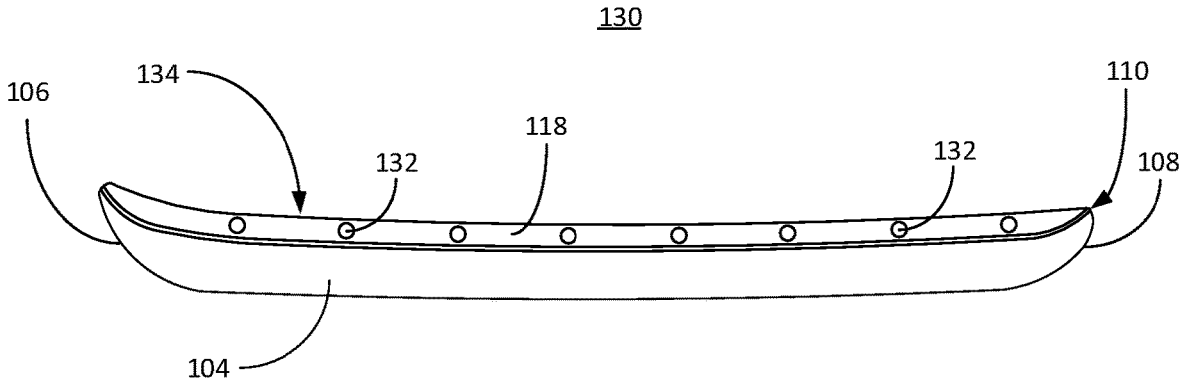
FIG. 1G illustratively depicts yet another embodiment of a skate runner consistent with embodiments of the present invention.

FIG. 1G illustratively depicts yet another embodiment of a skate runner consistent with embodiments of the present invention. As shown, the skate runner 130 possesses a smooth top edge 134 with a narrower width in the top region 118 as compared to the lower/bottom region 104. The skate runner 130 possesses circular perforations 132 that pass through the top portion 118 to create anchor points for an overmold. Though eight pass-through holes 132 are shown, there can be more or less without departing from the scope and spirit of the present invention. Certain embodiments envision different shaped perforations and in different orientations while maintaining functionality consistent with that of the present invention. Though the skate runner blade 130 possesses perforated holes 132, other embodiments envision countersinks and/or counterbores that do not fully extend through the blade 130.

Figure 1H:
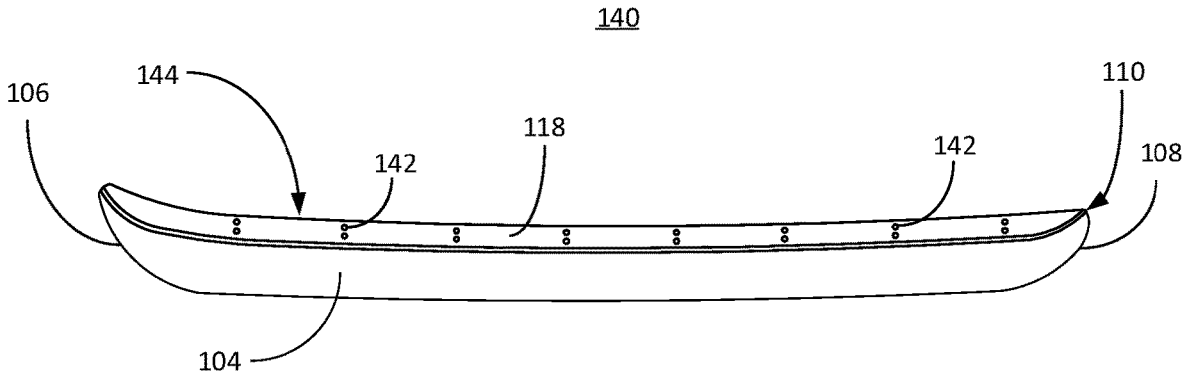
FIGS. 1H and 1I illustratively depict another embodiment of a skate runner consistent with embodiments of the present invention.
Figure 1I:
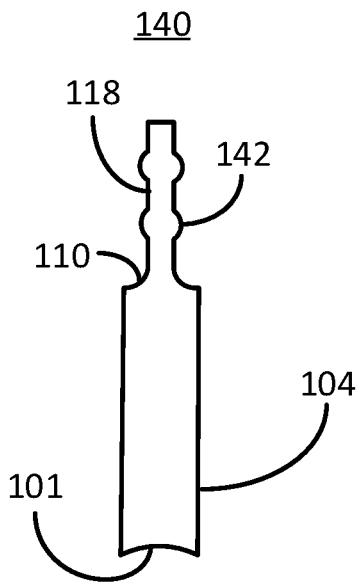

FIGS. 1H and 1I illustratively depict another embodiment of a skate runner consistent with embodiments of the present invention. Much like FIG. 1H, the skate runner 140 possesses a smooth top edge 144 with a narrower width at the top region than the lower region 104. The skate runner 140 possesses pairs of circular bumps 142 that protrude from the side of the top region 118. A cross-section of the circular bumps 142 is illustratively shown in FIG. 1I. As one skilled in the art will appreciate from the benefit of understanding the present application any number of protruding shapes and combinations of protruding shapes that improve the mechanical bonding of an overmold to the upper region 118 can be envisioned without departing from the scope and spirit of the present invention.

Figure 2A:
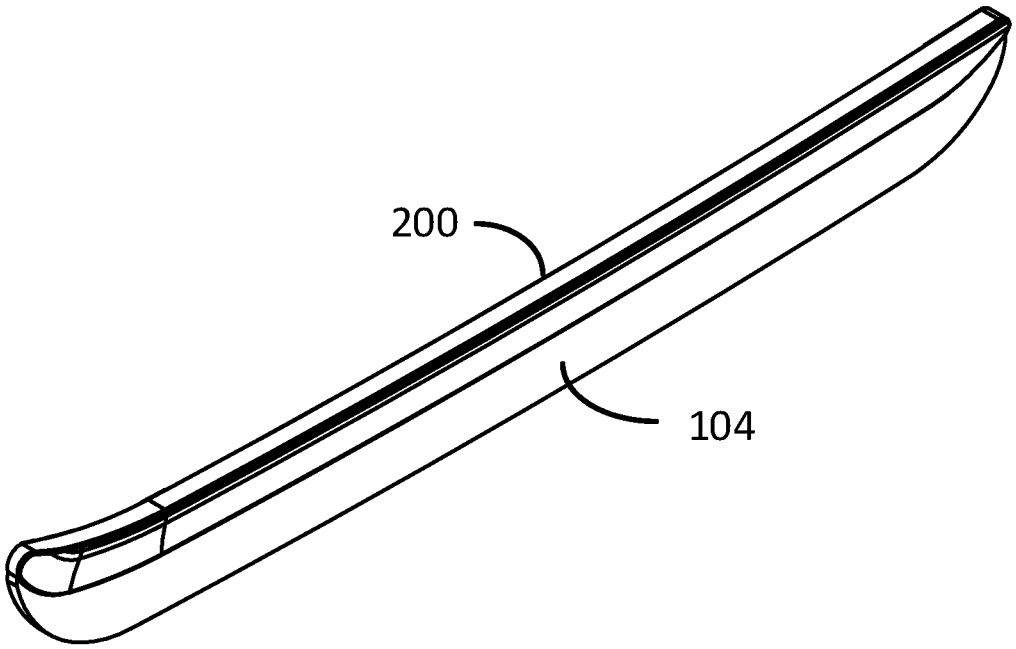
FIGS. 2A-2C illustratively depict line drawings of a skate runner blade coupled with an over mold core consistent with embodiments of the present invention.
Figure 2B:
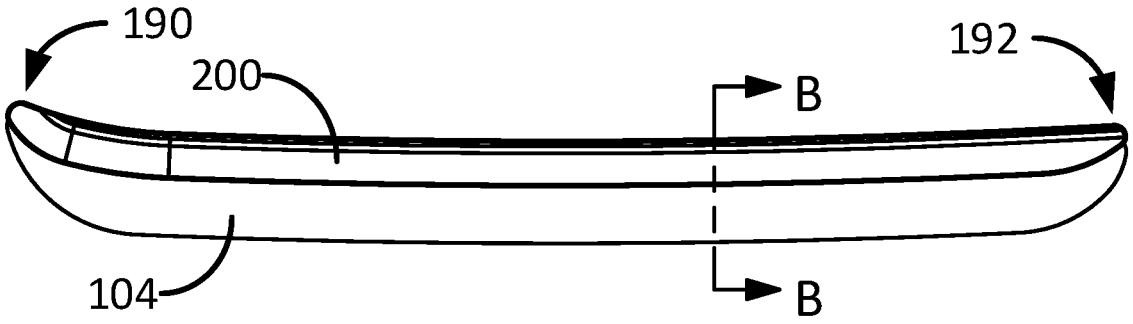
Figure 2C:
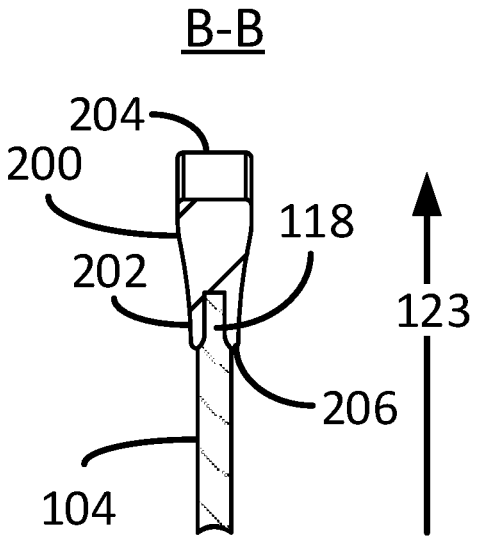

FIGS. 2A-2C illustratively depict line drawings of a skate runner blade coupled with an overmold core consistent with embodiments of the present invention. With reference to FIG. 2A, the top region 118 of the skate runner 100 (or a different embodiment of a skate runner, such as skate runner 130, 140, 150, 160, or other within the scope and spirit of the present invention), is essentially encased in an overmold core 200. The overmold core 200 essentially runs the length of the skate runner 100 from the front end 190 to the rear end 192, as shown in FIG. 2B. FIG. 2C illustratively depicts a line drawing of a cross sectional view along cross-section line B-B of FIG. 2B. As shown, the overmold core 200 extends vertically 123 to cover the blade top 121 and terminating at an over mold core top 204. Some embodiments envision the overmold core 200 extending beyond the blade top 121, which in certain instances could be between 0.025-0.5 inches. The overmold core 200 is envisioned fixedly attaching to, or otherwise locking over, the top region 118 of the skate runner 100. The overmold core 200 can encapsulate the attachment features, such as features 120 or 142 for example, or pass-through any through holes, such as the circular perforations 132 for example. Other embodiments envision the overmold core 200 being a unitary piece of material that can be a polymer (such as nylon), foam, carbon fiber, a glass filled composite, metallic or some other materials known to those skilled in the art. Certain embodiments envision the overmold core 200 constructed from a dampening material such as rubber or an engineered material with directionally engineered dampening properties. Optionally, the overmold core 200 can be constructed from different materials to provide variable stiffnesses along the length of overmold core 200.

Figure 3A:
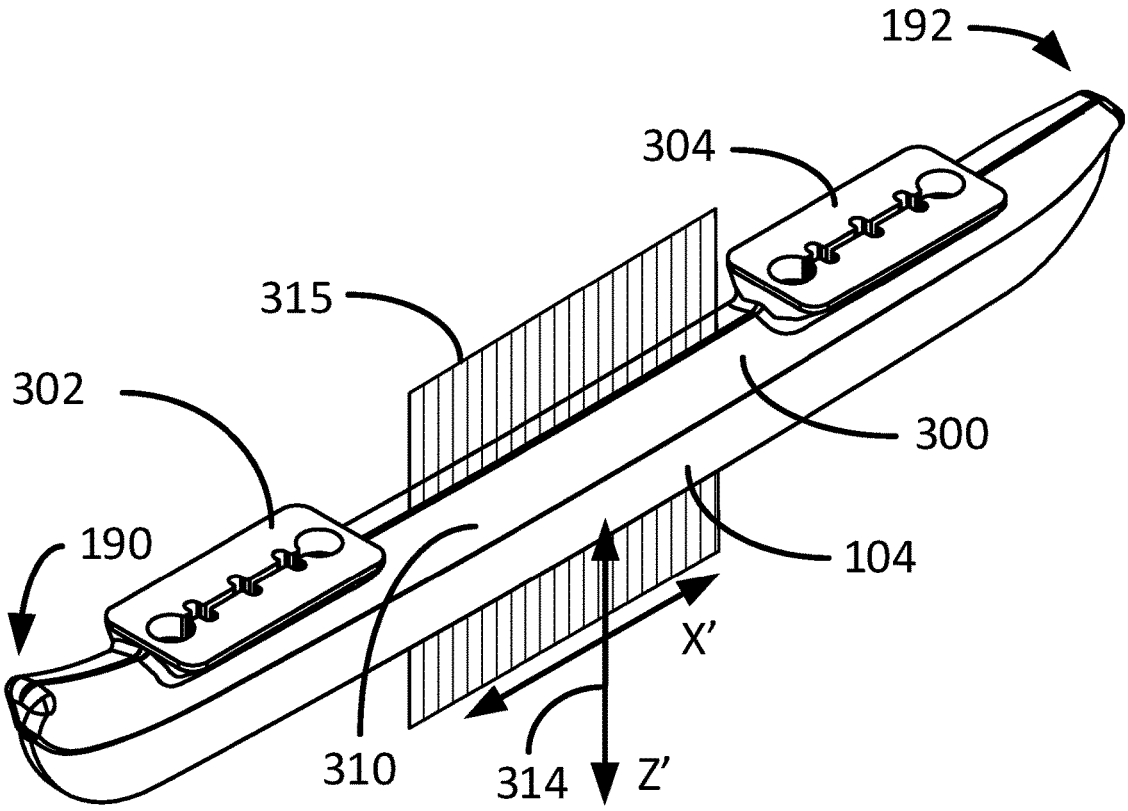
FIGS. 3A-3D illustratively depict line drawings of a skate runner blade and overmold core coupled with a skate overmold consistent with embodiments of the present invention.

FIGS. 3A-3D illustratively depict line drawings of a skate runner blade and overmold core coupled with a skate overmold 300 consistent with embodiments of the present invention. FIG. 3A is an isometric line drawing of the skate runner blade 100 and overmold core 200 that is essentially encased by the skate overmold 300. As shown, the skate overmold 300 essentially runs the length of the skate runner 100 from the front end 190 to the rear end 192 leaving the blade portion 104 exposed/uncovered. In the present embodiment, the skate overmold 300 comprises a front mounting surface 302 and a rear mounting surface 304.

Figure 3B:
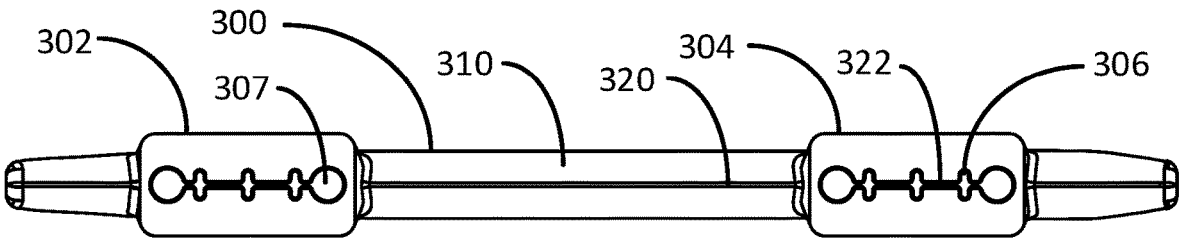

FIG. 3B illustratively depicts a top view line drawing of the skate overmold 300 wherein the front mounting surface 302 and the rear mounting surface 304 are essentially planar with the page. The mounting surfaces 302 and 304 are configured to attach the skate runner 100 and over mold 300 either directly or indirectly to the sole 680 of an ice-skating boot 699. Specifically, each of the mounting surfaces 302 and 304 possesses a female interlocking mount sleeve/receptacle 306, which in this embodiment is at least one circular hole 307 and a female slot and rib arrangement 322 adapted to receive a male counterpart, discussed later. The mounting surfaces 302 and 304 can be a unitary part of the skate overmold 300 or optionally fittings that attach or are molded into the skate overmold 300. In the present embodiment, the skate overmold 300 comprises a center seam 320 where two halves of the skate overmold 300 are compressed together wedging the overmold core 200 there between, while other embodiments envision the skate overmold 300 formed of a unitary piece of material. Some embodiments envision the mounting surfaces 302 and 304 being formed from the same material as the skate overmold 300, while other embodiments envision the mounting surfaces 302 and 304 formed out of a different material than the skate case that 300, such as metal or carbon composite for example.

Figure 3C:
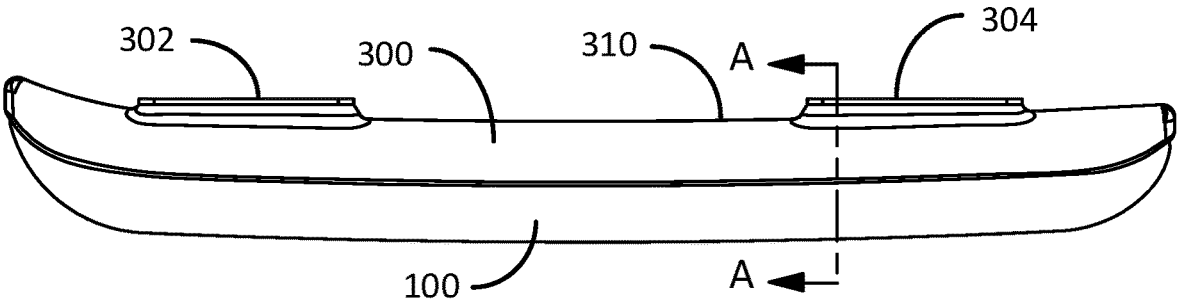

FIG. 3C illustratively depicts a side view line drawing of the skate runner 100 and overmold 300 with a cross-section line A-A passing through the rear mounting surface 304.

Figure 3D:
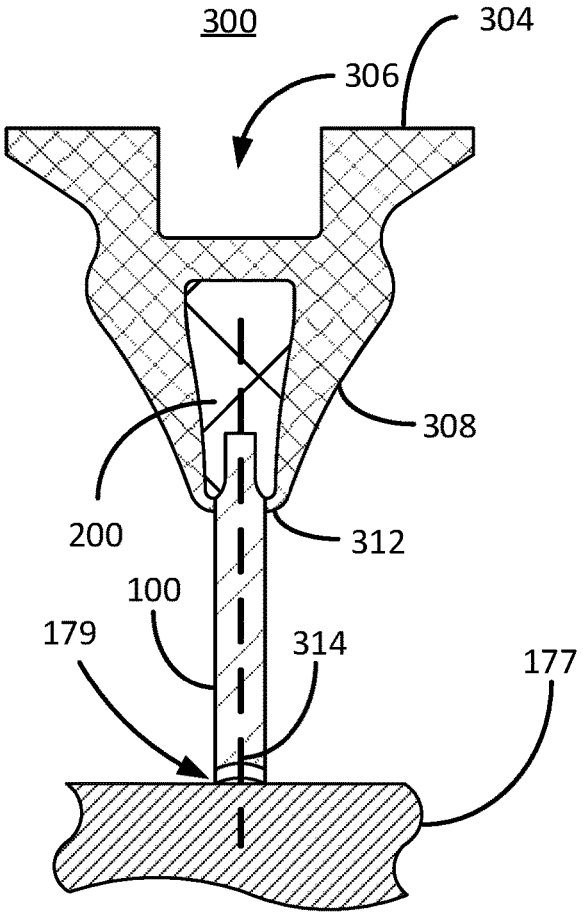

FIG. 3D illustratively depicts a cross-section line drawing along cross-section line B-B. As shown, the skate overmold 300 is defined by a sidewall 308 that extends between a blade/overmold (blade to overmold) interface 312 and an overmold top surface 310, which in this perspective is the rear mounting surface 304. Certain embodiments envision the skate overmold 300 being comprised of a different material than the overmold core 200 to create a material mismatch thereby reducing vibrational effects caused by relative motion at the interface 179 of the blade edge 101 with an ice sheet 177. In the present embodiment, it is easily seen that the skate overmold 300 completely encases the overmold core 200, however other embodiments are not so limiting. For reference, a neutral plane 315 is defined in the Z' direction along a central axis 314, that is centrally located, in the bottom width 128 in the vertical direction 123 and essentially along the blade length 195 in the X' as shown by the vertically hashed plane 315.

Figure 4A:
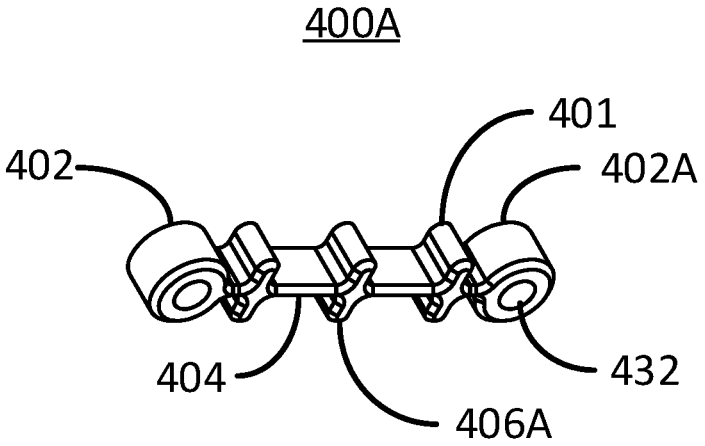
FIGS. 4A and 4B illustratively depict a line drawing of a standalone rib and backbone interlocking mount embodiment consistent with embodiments of the present invention.
Figure 4B:
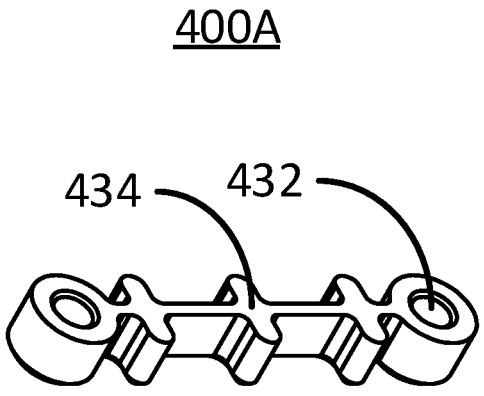

FIGS. 4A and 4B illustratively depict a line drawing of a standalone rib and backbone interlocking mount embodiment consistent with embodiments of the present invention. FIG. 4A shows a bottom perspective line drawing view of a standalone interlocking mount 400A with ribs 401 dispersed along a spine 404 between two cylindrical ends 402A. The cylindrical ends 402A comprise threaded through-holes 432 configured to receive threaded bolts (not shown). The standalone interlocking mount 400A cooperates with one of the matching sleeves/receptacles 306 wherein the bottom standalone mount surface 406A interfaces the bottom of the sleeve/receptacle 306. In other words, the standalone interlocking mounts 400A fit into the sleeve 306 like puzzle pieces, as can appreciated by the identical male and female geometries 400A and 306. The interlocking mounts 400A can be fixedly attached into the cooperating sleeves 306 (such as by glue, adhesive, mechanically attached or by other methods known to those skilled in the art). FIG. 4B illustratively shows a top view of the standalone interlocking mount 400A wherein certain embodiments envision the top surface 434 being flush with the mounting surface 302 or 304.

Though not limited to the rib 401 and spine 404 configuration, the present configuration provides distributed load and stiffness as well as additional adhesive contact area when affixed to the overmold. The standalone interlocking mounts 400A provide support for a digital adjusting system discussed later.

Figure 4C:
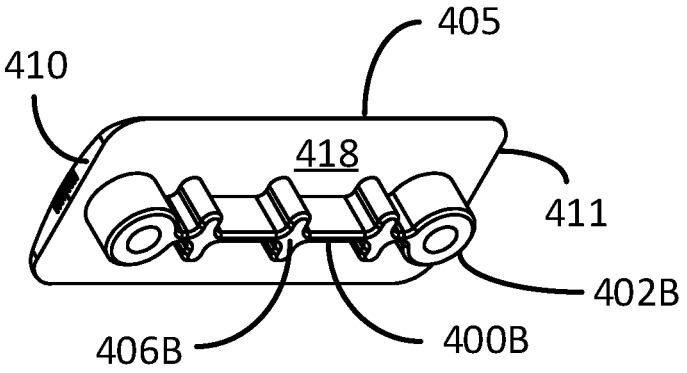
FIGS. 4C-4E illustratively depict line drawings of mounting plates with interlocking mounts consistent with embodiments of the present invention.
Figure 4D:
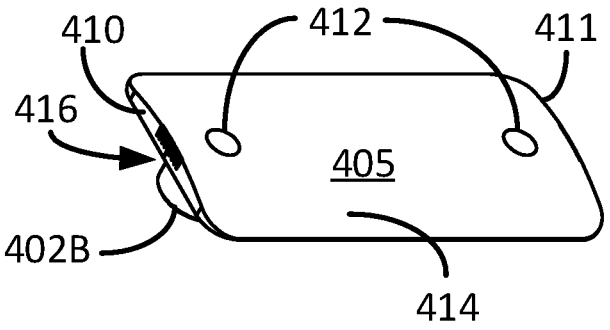
Figure 4E:
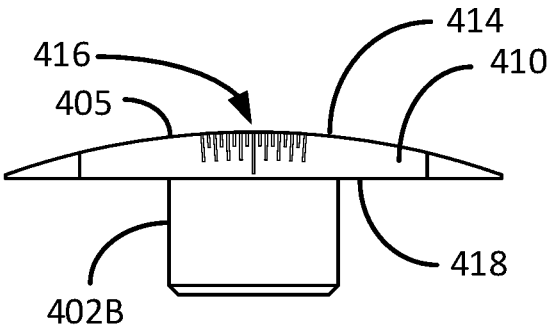

FIGS. 4C-4E illustratively depict line drawings of mounting plate embodiments with interlocking mounts consistent with embodiments of the present invention. As shown in FIG. 4C, the interlocking mounts 400B is more or less identical to 400A except that the interlocking mount 400B extend from the bottom mounting plate surface 418 of the mounting plate 405. Similar parts of 400 are denoted herein as 'A' and 'B' because though they are different elements they are configured similarly as will be appreciated in the description and figures. Each of the interlocking mounts 400B are configured to cooperate with a matching sleeve/receptacle 306 wherein the bottom standalone mount surface 406B interfaces the bottom of the sleeve/receptacle 306. The identical but opposite male and female geometries 400B and 306 closely conform to one another. The interlocking mounts 400B can be fixedly attached into the cooperating sleeves 306 (such as by glue, adhesive, mechanically attached or by other methods known to those skilled in the art). Certain embodiments envision the mounting plate 405 and the male interlocking mount 400B being of unitary construction. Certain other embodiments envision the mounting plate 405 and the male interlocking mount 400B being made out of metal, polymer, nylon, carbon composite, glass filled, or other materials known to those skilled in the art.

FIG. 4D illustratively depicts a line drawing top view of a mounting plate embodiment of FIG. 4C consistent with embodiments of the present invention. The mounting plate 405 comprises an arced top surface 414 that in some embodiments tracks a portion of a cylinder as shown. The cylinder segment 405 is defined as arcing around a contact axis 650 (see FIG. 6A). The rocker high point 113 of the blade edge 101 defines the contact axis 650 when the blade edge 101 is in the neutral plane 315. The mounting plate 405 possesses two bolt receiving tapped holes 412 adapted to receive threaded bolts (not shown here). The mounting plate 405 is defined by a front surface 410 and a back surface 411, whereby certain embodiments envision pronate/supinate graduated indicia 416 visibly disposed on at least the front surface 410. FIG. 4E illustratively depicts a line drawing of the front surface 410 of the mounting plate 405 showing the pronate/supinate graduated indicia 416. Certain other embodiments envision the pronate/supinate graduated indicia 416 comprising numbers, degrees, or other reference markings. In the present embodiment, the bottom mounting plate surface 418 is flat and interfaces/mates to one of the flat mounting surfaces 302 for 304. Certain other embodiments contemplate the bottom mounting plate surface 418 further adhering to the mounting surface 302 or 304. Other embodiments envision the bottom mounting plate surface 418 and the interlocking mount 400B being removably connected to a mounting surface 302 or 304.

Figure 5A:
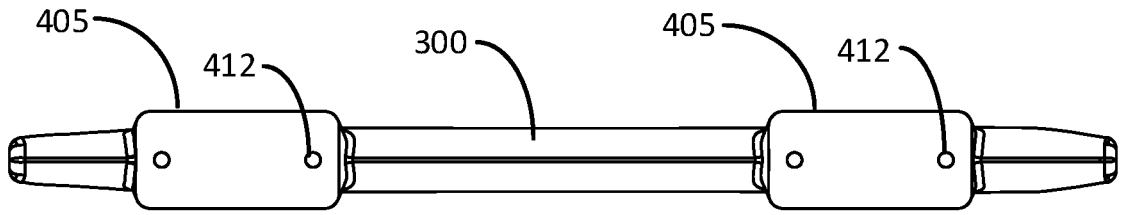
FIGS. 5A-5D illustratively depict line drawings of various views of mounting plate embodiments attached to the front and back mounting surfaces consistent with embodiments of the present invention.
Figure 5B:
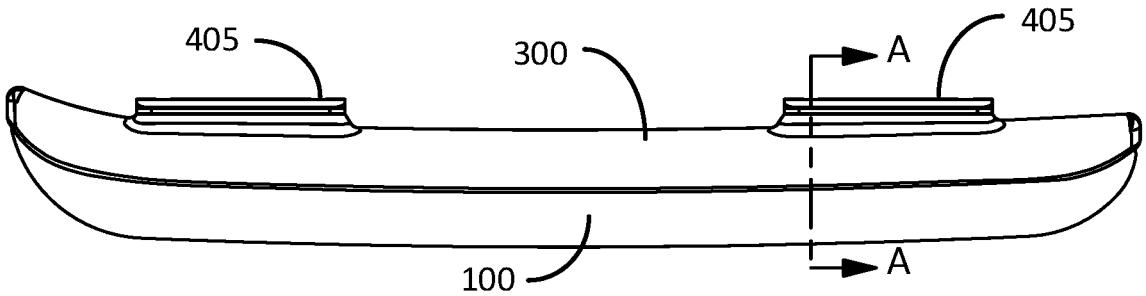
Figure 5C:
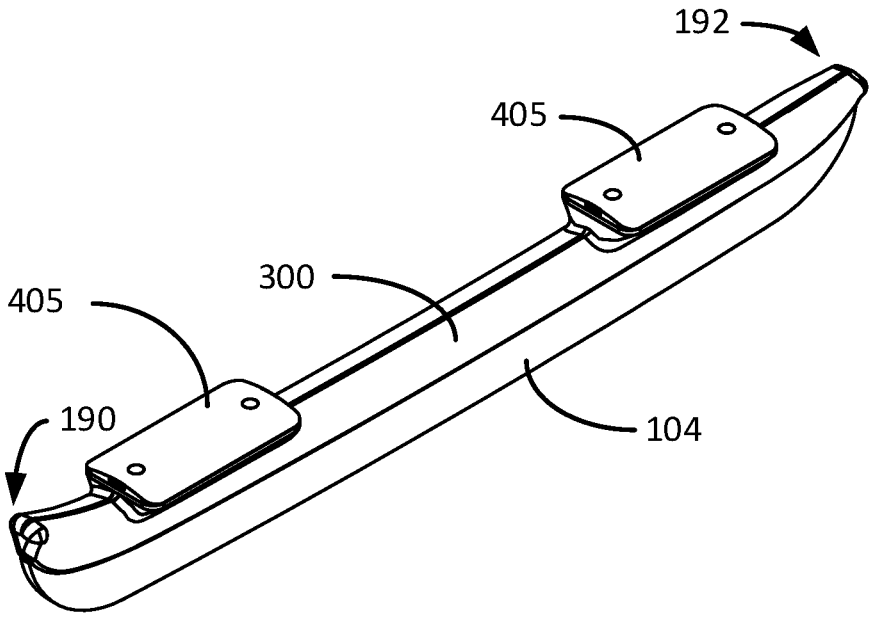
Figure 5D:
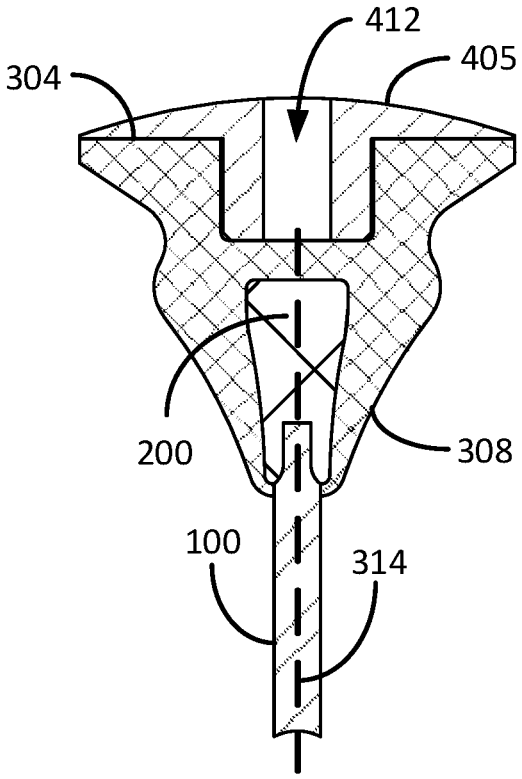

FIGS. 5A-5D illustratively depict line drawings of various views of mounting plate embodiments attached to the front and back mounting surfaces consistent with embodiments of the present invention. FIG. 5A shows a top view line drawing of a mounting plate 405 connected with a front mounting surface 302 and a mounting plate 405 connected with a rear mounting surface 304. FIG. 5B illustratively shows a side view line drawing of front mounting surface 302 and rear mounting surface 304 each connected with a mounting plate 405. A cross-section line A-A passing through the rear mounting surface 304 and mounting plate 405 is shown. FIG. 5C illustratively depicts a line drawing isometric view of mounting plates 405 connected with the front mounting surface 302 and the rear mounting surface 304. FIG. 5D illustratively shows a cross-section view of the relationship of the skate runner 100, the overmold core 200, the skate overmold 300 and the mounting plate 405 connected to the rear mounting surface 304. In the present embodiment, the aforementioned components 100, 200, 300, and 405 are symmetric in regards with the neutral plane 315. Also shown is one of the bolt receiving tapped holes 412 in the mounting plate 405 that is adapted and configured to receive a threaded bolt (not shown here).

Figure 6A:
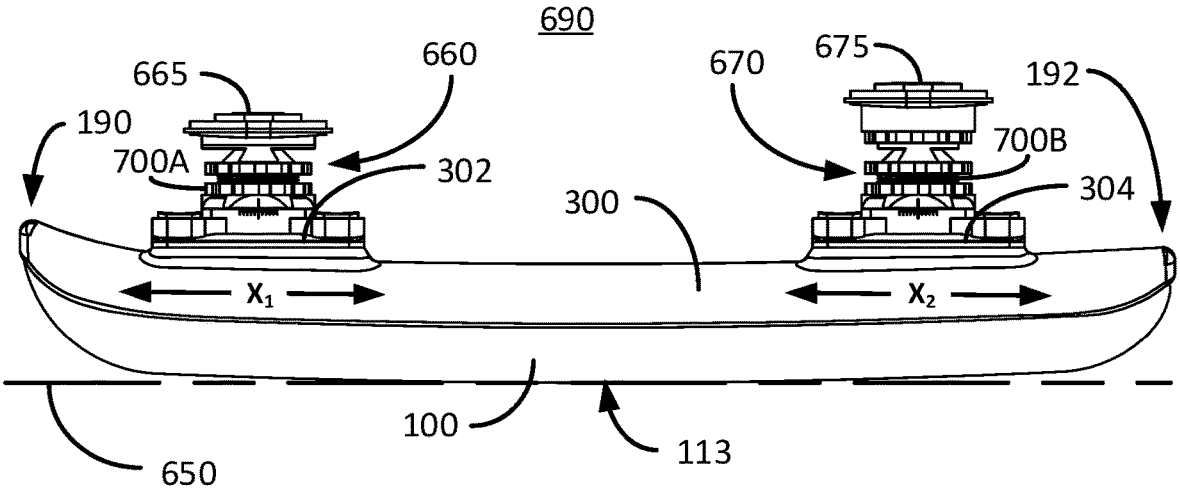
FIGS. 6A-6E are line drawings illustratively depict an overview of a multi-degree of freedom adjustment arrangement consistent with embodiments of the present invention.
Figure 10A:
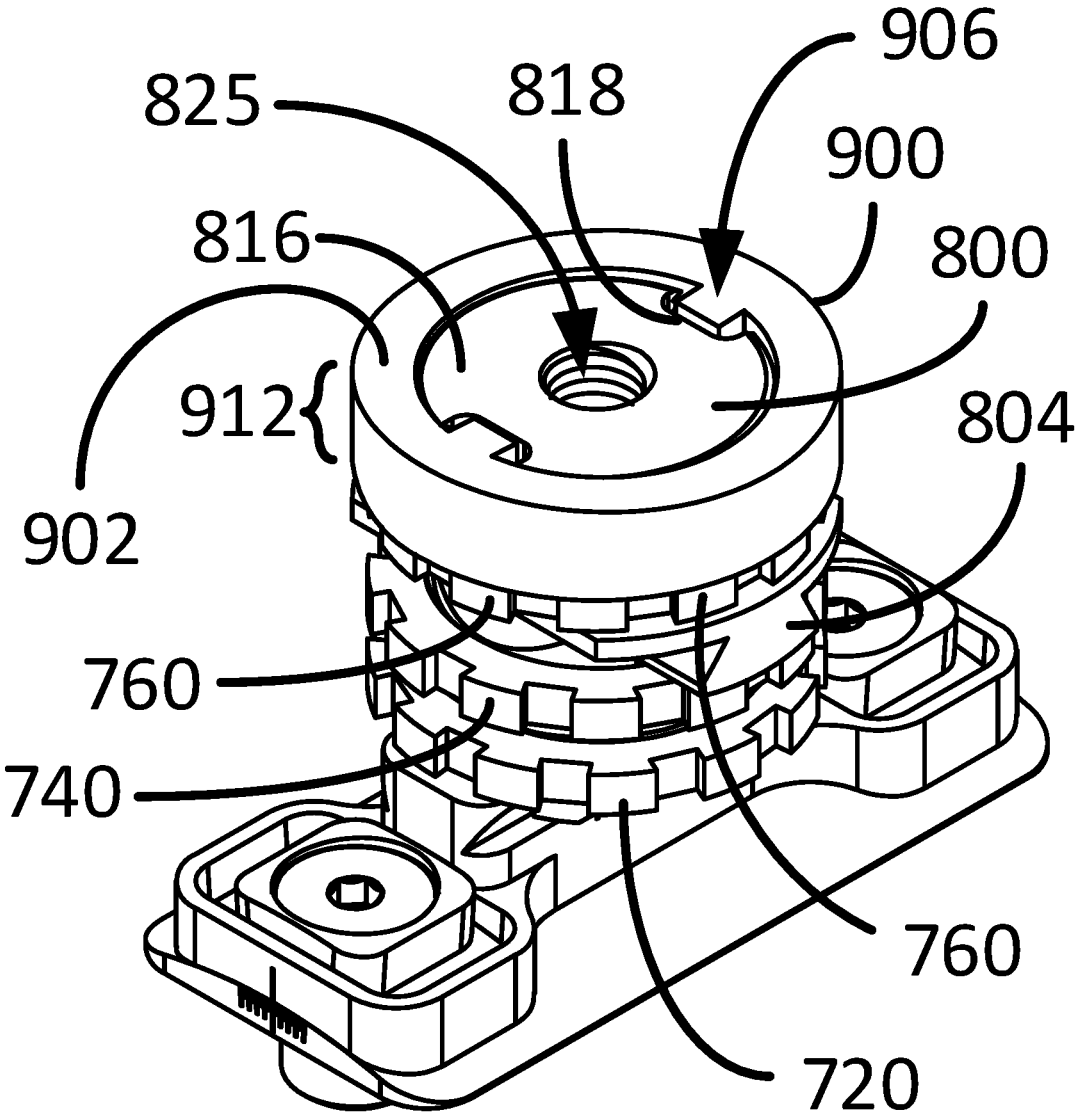
FIGS. 10A-10F illustratively depicts line drawings of a lift ring embodiment cooperating with the side/side locking dovetail module 800 consistent with embodiments of the present invention.

FIGS. 6A-6E are line drawings illustratively depict an overview of a multi-degree of freedom adjustment post arrangement consistent with embodiments of the present invention. FIG. 6A illustratively depicts a side view line drawing of a skate assembly 690 that includes the skate runner 100 and skate overmold 300 with front and rear multi-degree of freedom arrangements 660 and 670. The front and rear multi-degree of freedom arrangements 660 and 670 essentially take the place of a static ice skate post that connects a skate blade to a skate boot sole 680. Hence, the front and rear multi-degree of freedom arrangements 660 and 670 can also be considered front and rear multi-degree of freedom skate posts 660 and 670. As shown in FIG. 6A, the front multi-degree of freedom arrangement 660 is adjustably connected with the front mounting surface 302 and mounting plate 405 and can be moved in the $X_1$ direction. The rear multi-degree of freedom arrangement 670 is adjustably connected with the rear mounting surface 304 and mounting plate 405 and can be moved in the $X_2$ direction. The $X_1$ and $X_2$ directions are synonymously used herein with the terminology 'fore' and 'aft' directions. The front multi-degree of freedom arrangement 660 attaches to the ice skating boot front end 698 at front attachment plate 665. The rear multi-degree of freedom arrangement 670 attaches to the ice skating boot rear end 696 at rear attachment plate 675. Certain embodiments contemplate the front and rear attachment plates 665 and 675 being convex to conform to the shape of lift rings 900 (as shown in FIG. 10A). Also as shown, the rocker high point 113 of the blade edge 101 defines the contact axis 650 when the blade edge 101 is in the neutral plane 315 (such as when the blade edge 101 is in contact with a sheet of ice 177.

The front and rear multi-degree of freedom arrangements 660 and 670 each possess a bi-directional locking module 700A and 700B, respectively discussed in more detail in conjunction with FIG. 8A-8J. Because the bi-directional locking modules 700A and 700B are responsible for the $X_1$ and $X_2$ directions, certain embodiments envision disengaging the skate runner 100 and skate overmold 300 with front and rear multi-degree of freedom arrangements 660 and 670 when the bi-directional locking modules 700A and 700B are loosened. When the front and rear multi-degree of freedom arrangement 660 and 670 are attached to the sole 680 of an ice-skate boot 699, disengaging the skate runner 100 and skate overmold 300 front and rear multi-degree of freedom arrangements 660 and 670 effectively disengages the skate runner 100 and skate overmold 300 from the ice-skate boot 699. This can facilitate swapping out a different skate runner 100 and skate over mold 300 quickly and easily. A different skate runner 100 and skate over mold 300 can include a longer blade, a thinner blade, a more flexible blade, a different material blade, a sharpened blade, etc.

Figure 6B:
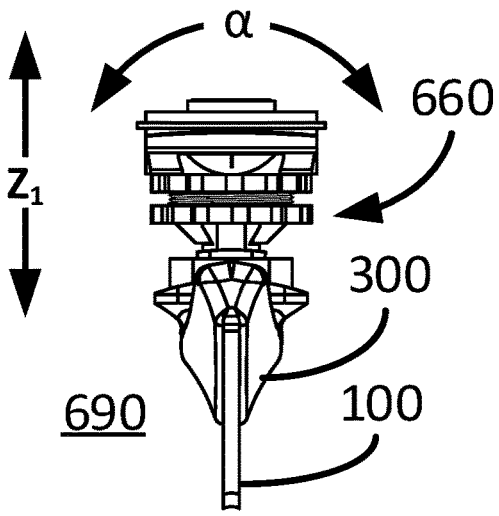

FIG. 6B illustratively depicts a line drawing of a front view of the skate assembly 690 embodiment with the front multi-degree of freedom arrangement 660 consistent with embodiments of the present invention. Here, the front multi-degree of freedom arrangement 660 is adjustable in the $Z_1$ directions, also referred to herein as up and down directions and $\alpha$ angular rotation, and the positive and negative direction as indicated by the two-way arrow also referred to herein as pronate/supinate angle.

Figure 6C:
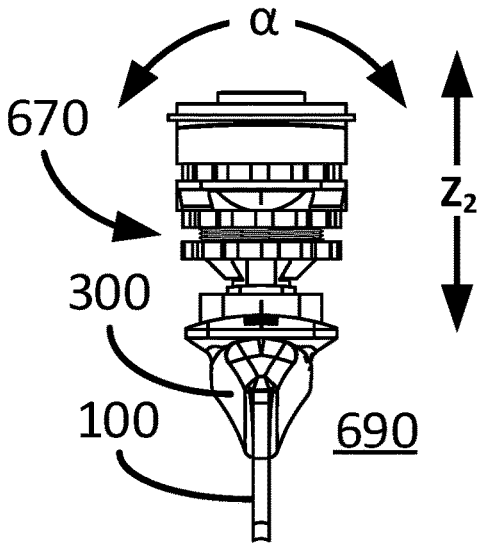

FIG. 6C illustratively depicts a line drawing of a rear view of the skate assembly 690 embodiment with the rear multi-degree of freedom arrangement 670 consistent with embodiments of the present invention. Here, the rearrear multi-degree of freedom arrangement 670 is adjustable in the $Z_2$ directions, and $\alpha$ angular rotation and the positive and negative direction as indicated by the two-way arrow.

Figure 6D:
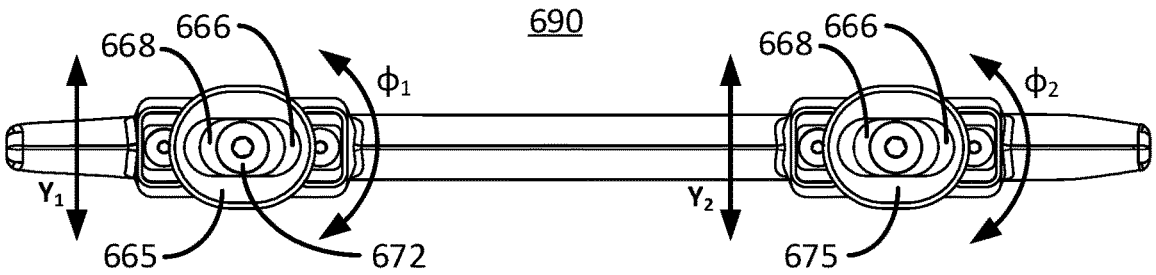

FIG. 6D illustratively depicts a top view line drawing of the skate assembly 690 embodiment consistent with embodiments of the present invention. As shown here, the front multi-degree of freedom arrangement 660 can be made to move in a side to side direction $Y_1$ as shown, also referred to herein as 'side/side', and an angular rotation $\Phi_1$ in the same plane as the side direction $Y_1$. Similarly, the rear multi-degree of freedom arrangement 670 can be made to move in a side to side direction $Y_2$ as shown, and an angular rotation $\Phi_2$ in the same plane as the side direction $Y_2$. Hence, the front multi-degree of freedom arrangement 660 can be made to move in at least the $Y_1$, $X_1$, $\Phi_1$, $\alpha$ directions and the rear multi-degree of freedom arrangement 670 can be made to move in at least the $Y_2$, $X_2$, $\Phi_2$, $\alpha$ directions. As will be appreciated based on the present description, the skate runner 100 can be moved with respect/relative to the boot sole 680 independently (from a different degree of freedom) in each degree of freedom. In other words, one adjustment direction is not required to be dependent on a different adjustment direction.

With reference to the top portion of the front multi-degree of freedom arrangement 660, the front attachment plate 665 is shown cooperating with an elongated washer 668 that slidingly fits in an even longer elongated washer recess 666. The front attachment plate 665, elongated washer 668 can be fixedly locked into position via a threaded top bolt 672. For purposes of description, a threaded bolt possesses a threaded bolt shaft and bolt head all of which are uniformly described under the element a threaded bolt, which in this case is the threaded bolt 672 but is not limited in this disclosure to the threaded bolt 672. In certain embodiments, the threaded top bolt head 672 is inside of a boot sole 680 thereby locking the front attachment plate 665, elongated washer 668 and fixedly attaching the front multi-degree of freedom arrangement 660 to the outside of the boot sole 680. In other words, the top bolt 672 can be used to fixedly attach the front multi-degree of freedom arrangement 660 to the outside of an ice-skating boot sole 680. Likewise, top portion of the rear multi-degree of freedom arrangement 670, the front attachment plate 675 is shown cooperating with an elongated washer 668 that slidingly fits in an even longer elongated washer recess 666. The rear attachment plate 675, elongated washer 668 can be fixedly locked into position via a threaded top bolt 672. The threaded top bolt head 672 can fixedly attach the rear attachment plate 675, elongated washer 668 and the rear multi-degree of freedom arrangement 670 to the outside of the boot sole 680. Accordingly, the two the top bolts 672 can be used to fixedly attached the front multi-degree of freedom arrangement 660 and the rear multi-degree of freedom arrangement 670 to the outside of an ice-skating boot sole 680.

Figure 6E:
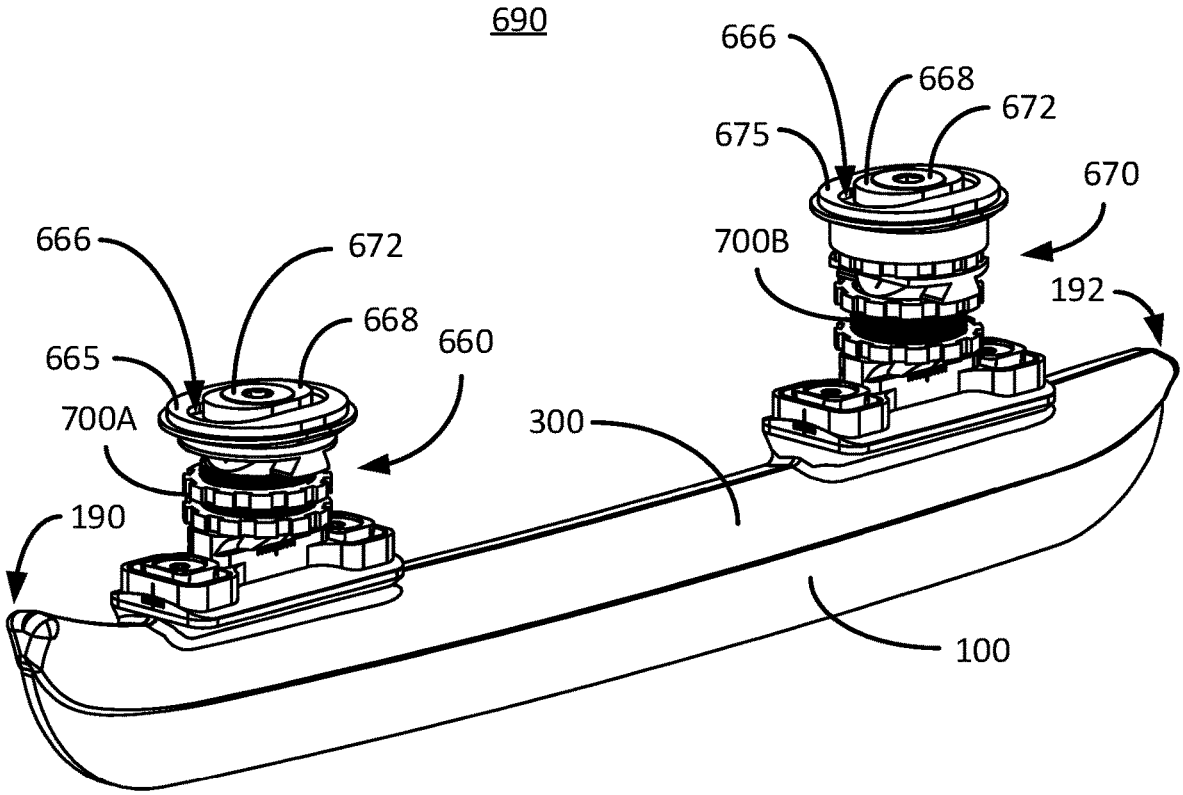

FIG. 6E illustratively depicts an isometric line drawing of the skate assembly 690 that includes the skate runner 100 and skate overmold 300 built up with front and rear multi-degree of freedom arrangements 660 and 670. As shown, the front multi-degree of freedom arrangement 660 is shown built up with the front attachment plate 665 cooperating with the elongated washer 668 that slidingly fits in the even longer elongated washer recess 666. As can be more easily seen from this vantage, the front attachment plate 665, elongated washer 668 can be fixedly locked into position via a threaded top bolt 672. Likewise as shown, the rear multi-degree of freedom arrangement 670 is shown built up with the rear attachment plate 675 cooperating with the elongated washer 668 that slidingly fits in the even longer elongated washer recess 666 all fixedly held in place with the threaded bolt head 672 pulling/compressing all the components into compression.

Figure 6F:
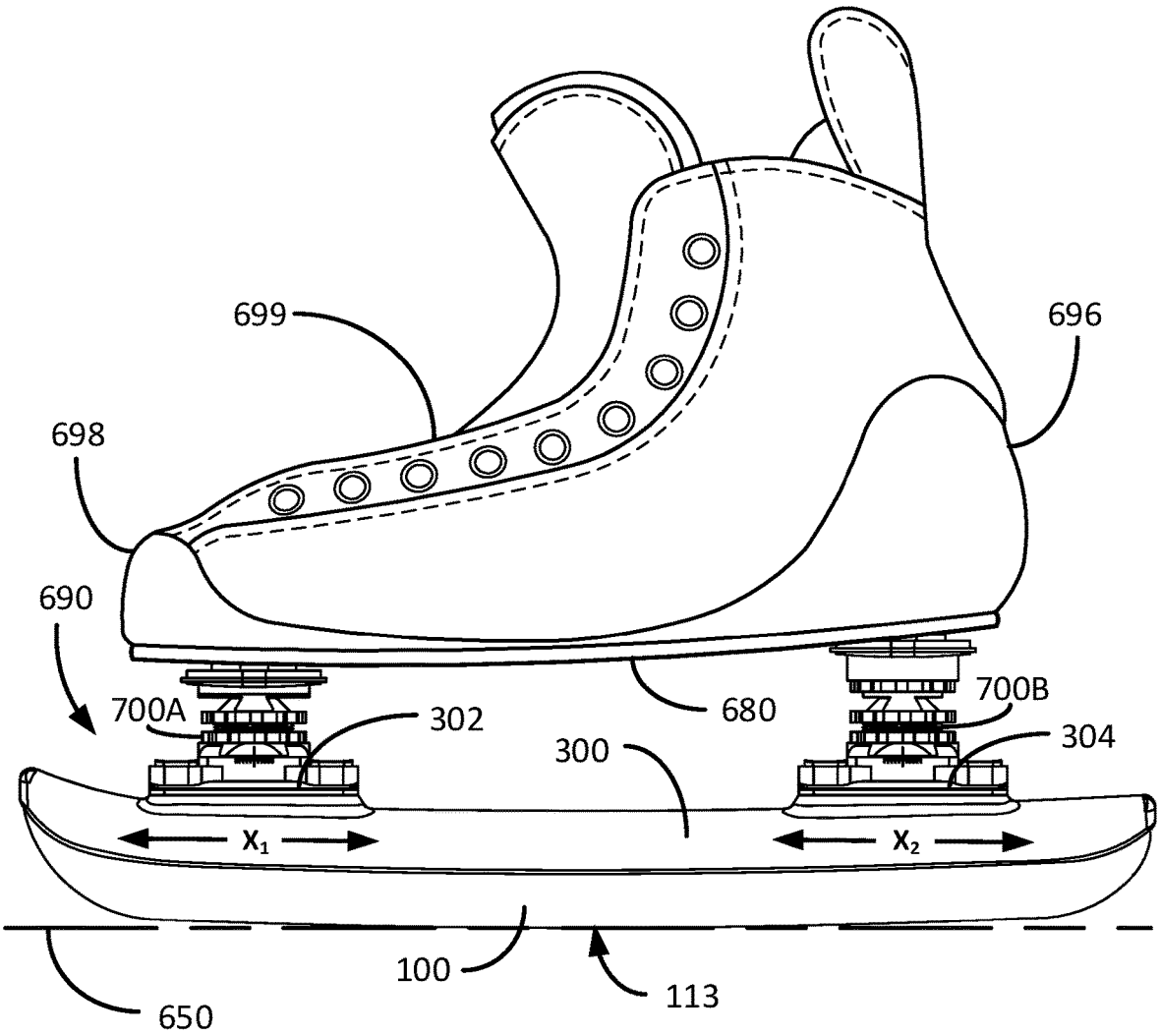
FIG. 6F illustratively depicts the skate assembly connected with an ice-skate boot consistent with embodiments of the present invention.

FIG. 6F illustratively depicts the skate assembly 690 connected with an ice-skate boot 699 consistent with embodiments of the present invention. As depicted, the threaded bolts 672 connect the ice-skate boot sole 680 to the front and rear multi-degree of freedom arrangements 660 and 670 at the front and rear attachment plates 665 and 675, respectively.

Figure 7A:
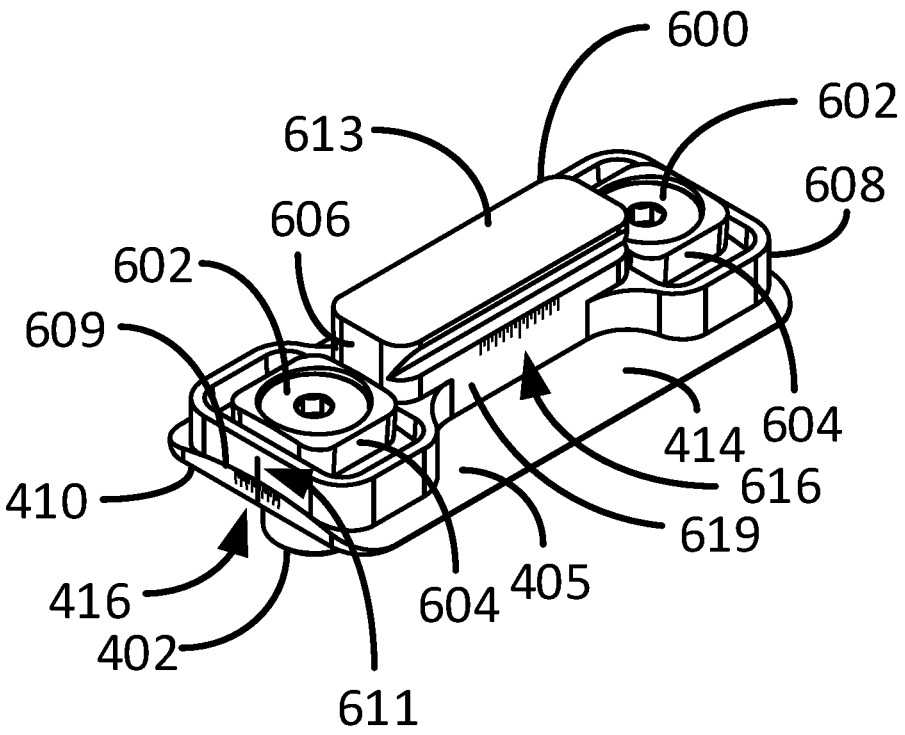
FIGS. 7A-7G illustratively depict line drawings of a pronate/supinate platform embodiment consistent with embodiments of the present invention.
Figure 7B:
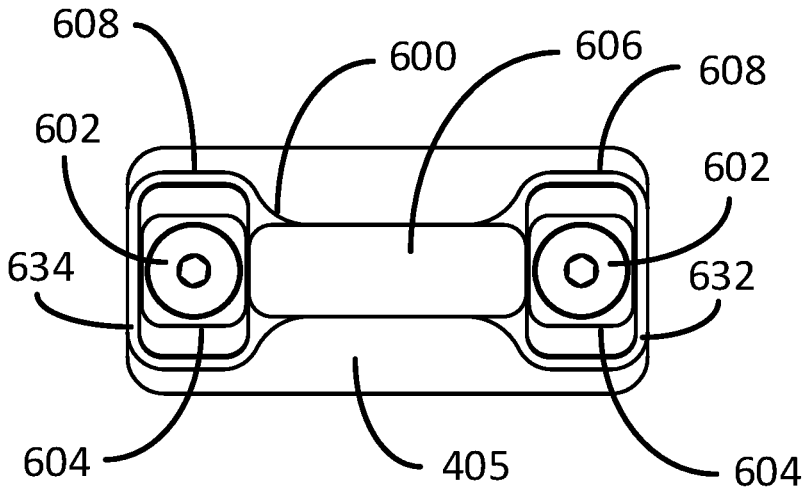

FIGS. 7A-7G illustratively depict line drawings of a pronate/supinate platform embodiment consistent with embodiments of the present invention. FIG. 7A is an isometric line drawing of a pronate/supinate platform 600 that is adjustably connected/attached to a mounting plate 405. The geometry of the platform bottom surface 609 matches the convex arc cylindrical segment 414 of the mounting plate 405 to rotate left and right in a sliding manner about the cylindrical segment 414. In other words, the platform bottom surface 609 is a concave arc that can rock angularly side by side about the convex arc cylinder segment 414 of the mounting plate 405 when in contact (in a mating/cooperating relationship). As also shown in FIG. 7B, pronate/supinate platform 600 has a pair of rectangular square nut cages 608, one at the platform front 634 and one at the platform rear 632. The square nut cages 608 are recesses that essentially trap a square nut 604 from turning when tightened down when screwed into place via a threaded bolt 602, as shown. The bottom of each square nut cage 608 has a slotted hole 604 for the threaded bolt 602 to go through, see FIG. 7F. The threaded bolt 602 engages and screws into a respective tapped hole 412 in the mounting plate 405, which in some embodiments are the two cylindrical threaded ends 402B on the underside 418 of the mounting plate 405 (see FIG. 4C). In this way, the pronate/supinate platform 600 can rock angularly side by side in a sliding fashion about the cylindrical segment 414. The threaded bolts 602 can lock the pronate/supinate platform 600 in a desired position when tightened.

Figure 7C:
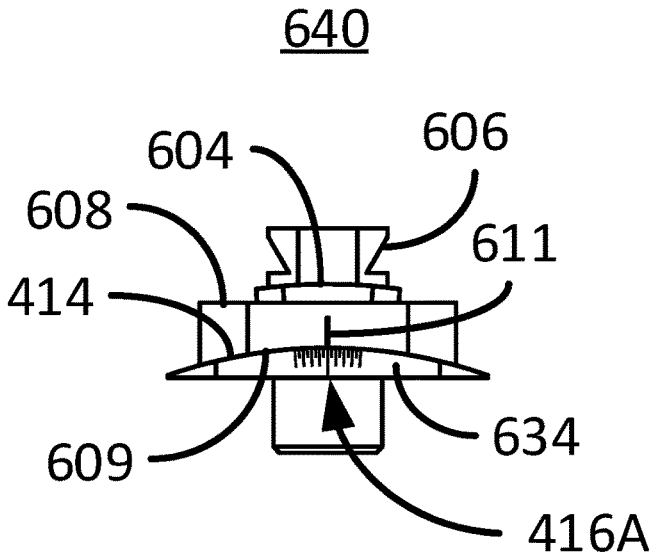
Figure 7D:
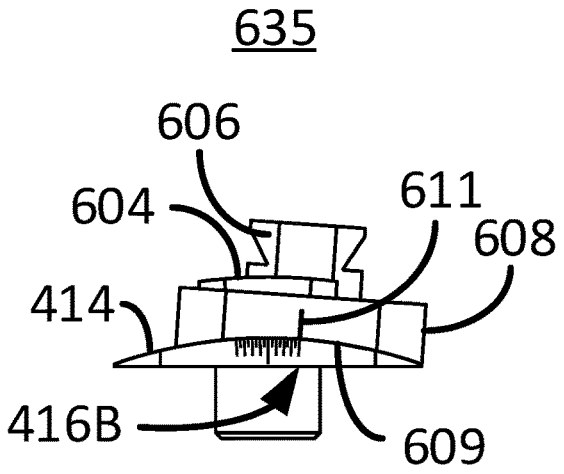
Figure 7E:
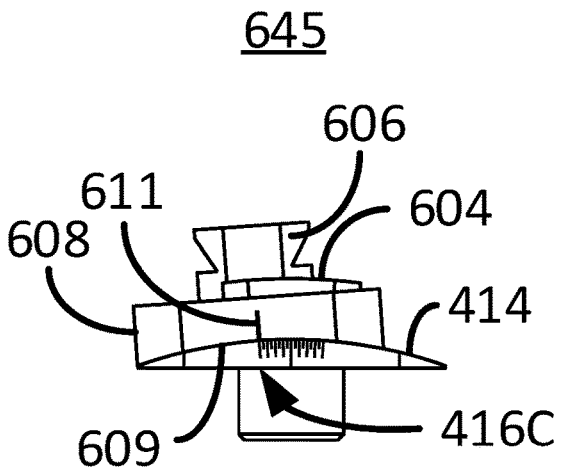

FIGS. 7C-7E illustratively depict pronate and supinate motion of the pronate/supinate platform 600 relative to the mounting plate 405 consistent with embodiments of the present invention. In FIG. 7C, the pronate/supinate platform 600 is in a neutral position 640 (0° offset) on the mounting plate 405. When in the neutral position 640, a pronate/supinate centerline pointer 611 is in the center graduated indicium 416A of the pronate/supinate graduated indicia 416 indicating to an onlooker of the neutral position. The threaded bolt 602 can be tightened in each respective tapped hole 412 thereby compressing and rigidly fixing the pronate/supinate platform 600 and the mounting plate 405 together. Certain embodiments contemplate interlocking features at the convex and concave arced interface 414 and 609 to assist in locking the pronate/supinate platform 600 and the mounting plate 405 together. To move or otherwise adjust the pronate/supinate platform 600 to either be in a pronation position 635 or a supination position 645, a user needs to loosen each respective the threaded bolt 602 and move the pronate/supinate platform 600 to a desired position along the pronate/supinate graduated indicia 616. Once in the desired position the threaded bolt 602 can be tightened down to clamp the pronate/supinate platform 600 and the mounting plate 405 together. The front profile of the fore/aft male interlocking slide mount, which in this embodiment is a dovetail 606 is shown here and as shown in other figures, extends towards the fore/aft dovetail top 613 of the pronate/supinate platform 600. The male interlocking slide mount is configured to engage a female interlocking slide mount receptacle, such as a dovetail channel. As shown in FIG. 7A, the fore/aft dovetail 606 also extends longitudinally parallel to the contact axis 650 along the pronate/supinate platform top surface 613, which is to the concave arc 609 obverse (i.e., on the other side of the pronate/supinate platform 600). The fore/aft graduated indicia 616 are visibly disposed on at least one pronate/supinate platform side surface 619 along the side of the fore/aft dovetail 606. In the present embodiment, the fore/aft graduated indicia 616 have a centerline that is longer than the other fore/aft graduated indicia 616 to mark the neutral fore/aft position. Embodiments of the present invention commonly use a dovetail and channel configuration as an example of a male interlocking slide mount and female interlocking slide mount receptacle whereby optional structures can be used without departing from the scope and spirit of the present invention are envisioned and obvious with the benefit of understanding the present invention. Optional structures can include elements such as spheres in a channel, round profile bars in a channel, other shaped bars (different from a dovetail) and compatible channel, or other shaped male and female parts that accomplish the same motion while maintaining the same functionality within the scope and spirit of the present invention.

FIG. 7D shows the pronate/supinate platform 600 in a pronation position 635 on the mounting plate 405. In this far pronation position 635, the pronate/supinate centerline pointer 611 is pointing to the far right graduated indicium 416B of the pronate/supinate graduated indicia 416. The threaded bolt 602 can be tightened in the respective tapped hole 412 thereby compressing and rigidly fixing the pronate/ supinate platform 600 and the mounting plate 405 together in the desired pronation position 635. Accordingly, the fore/aft dovetail 606 and all other elements extending upward from the fore/aft dovetail 606 are fixed/set in the pronation position 635 based on the desired pronation setting, which is easily determined via the pronate/supinate centerline pointer 611 and the desired graduated indicium 416. Likewise, as shown in FIG. 7E by loosening the threaded bolt 602, the pronate/supinate platform 600 can be moved to a supination position 645 on the mounting plate 405 and then fixed in position by retightening the threaded bolt 602. In this far left supination position 645, the pronate/supinate centerline pointer 611 is in the far left graduated indicium 416C of the pronate/supinate graduated indicia 416.

Figure 7F:
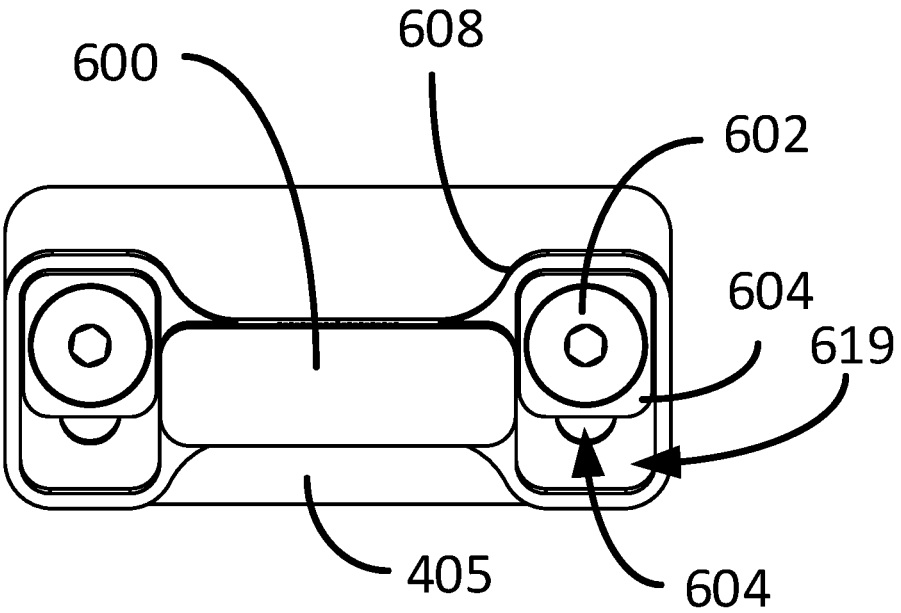

FIG. 7F illustratively depicts a top view line drawing of the pronate/supinate platform embodiment 600 adjusted to a different angular position on the mounting plate 405. As shown, the square nuts 604 are shifted to the far side of the square nut cages 608 thereby changing the position of the fore/aft dovetail 606 in either a supinated or a pronated position, depending on your point of reference (i.e., if this is a right skate runner or a left skate runner, for example). As discussed earlier, each square nut cage 608 is essentially a recess with a bolt slot 604 that accommodates the shaft of the bolt 602 to pass-through the square nut cage floor 619, as shown. The bolt slots 604 allow the sliding movement of the pronate/supinate platform 600 over the arced mounting plate 405 when the two elements 600 and 405 are loosely connected together by the loosened but still engaged bolts 602. The square nuts 604 cooperating with the square nut cages 608 allow for an infinite number of positions within the rectangular length of each square nut cages 608. In the present embodiment, the pronate/supinate positions can be +/−4°, however other angular ranges, such as between +/−10°, or other, are envisioned within the scope and spirit of the present invention. As should be appreciated, when the threaded bolts 602 are tightened down, the bolt head 602 effectively compresses the square nut 604 into the square nut cage floor 619 fixedly clamping the pronate/supinate platform 600 to the mounting plate 405. As described earlier in conjunction with FIG. 4C, the threaded bolts 602 screw into the two cylindrical threaded ends 402B on the underside 418 of the mounting plate 405. When compressed, the frictional forces between these elements 602, 604, 619, 600 and 405 dominate holding these elements 602, 604, 619, 600 and 405 tightly together in a fixed manner.

Figure 7G:
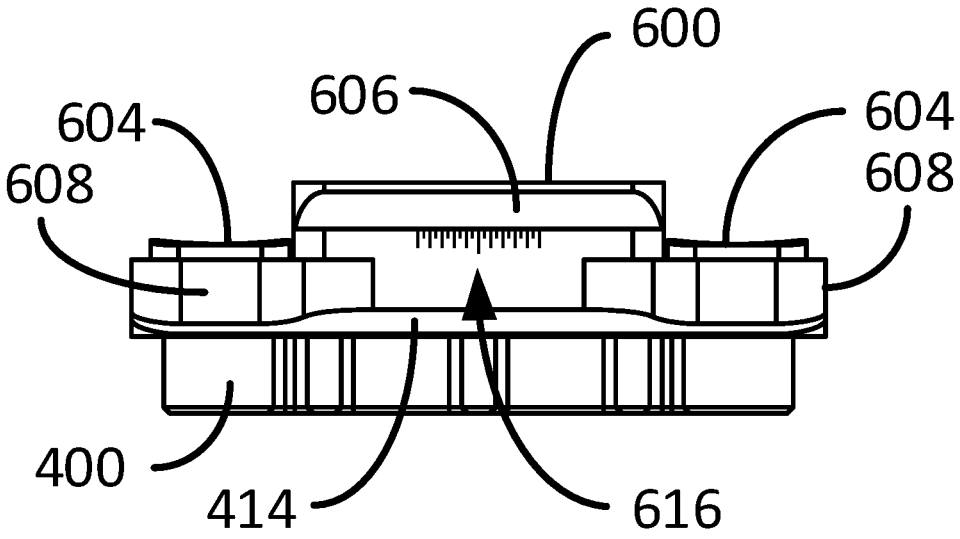

FIG. 7G illustratively depicts a side view line drawing of the pronate/supinate platform embodiment consistent with embodiments of the present invention. As shown, the pronate/supinate platform 600 sits on top of the mounting plate 405 with the fore/aft graduated indicia 616 visibly displayed just underneath the fore/aft dovetail 606. When in view of FIGS. 6A-6E, it should be appreciated that the skate blade and runner 100/300 will effectively be angled in a desired pronate/supinate angle relative to an ice skating boot sole 680 when the pronate/supinate platform 600 is adjusted with respect to the mounting plate 405.

Certain embodiments envision the pronate/supinate platform 600 not having the dovetail 606, but rather extending directly into the ice-skating boot sole 680. This would effectively restrict the degree of freedom for the ice skate (boot 699 and skate blade 100) to the pronation and supination directions a.

Figure 7H:
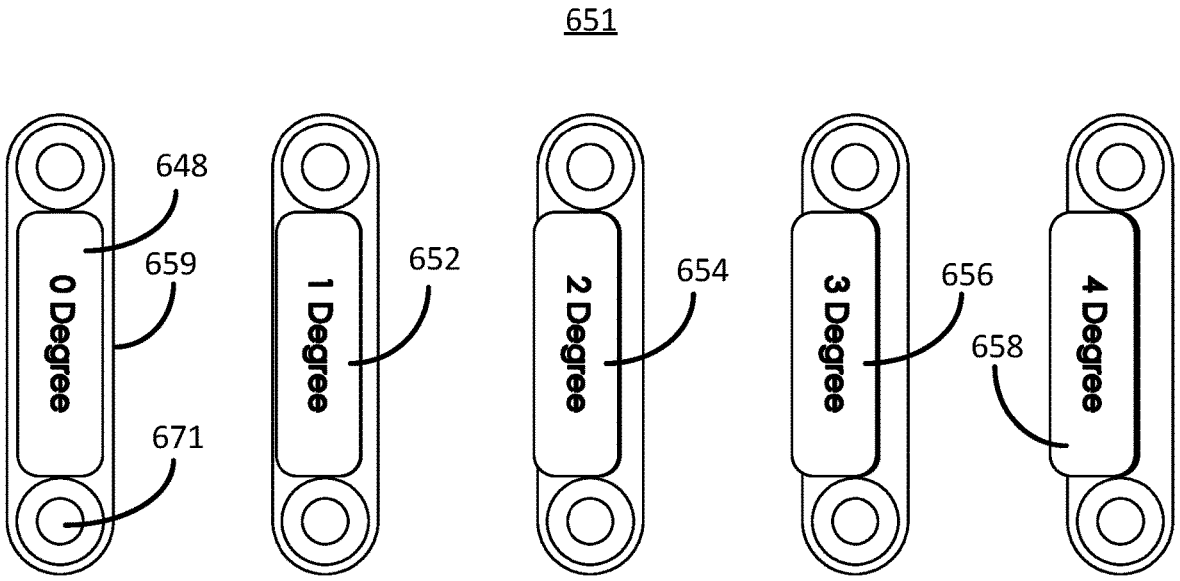
FIGS. 7H-7J are line drawings that illustratively depict of digital pronate/supinate platforms with individual fore/aft dovetail placement configurations consistent with embodiments of the present invention.

FIG. 7H are top view line drawings that illustratively depict different digital angled pronate/supinate platforms with nonadjustable fore/aft dovetail configurations consistent with embodiments of the present invention. Unlike the adjustable pronate/supinate platform 600, each digital pronate/supinate platform 651 has a fixed offset for the fore/aft dovetail measured in degrees. As shown here, there are a) a 0° (neutral) pronate/supinate positioned fore/aft dovetail 648; b) a 1° pronate/supinate positioned fore/aft dovetail 652; c) a 2° pronate/supinate positioned fore/aft dovetail 654; d) a 3° pronate/supinate positioned fore/aft dovetail 656; and e) a 4° pronate/supinate positioned fore/aft dovetail 658 (even though 0-4 deg are shown, larger angles and different angles are envisioned). There are two platform through-holes 671 spaced at either end of each digital pronate/supinate platform 651 to align and attach to the threaded through-holes 432 in cylinders 402A of the standalone interlocking mount 400A. In this embodiment, there is no need for the mounting plate 405 or the other elements to facilitate pronate/supinate adjustability within a single system. Rather, this embodiment employs multiple single digital elements to accomplish altering the pronation and supination angle. Advantages of the standalone interlocking mount 400A and the digital pronate/supinate platforms 651 includes weight reduction and simpler parts. A disadvantage is freedom to adjust supination and pronation within a single system 405 and 600.

Figure 7I:
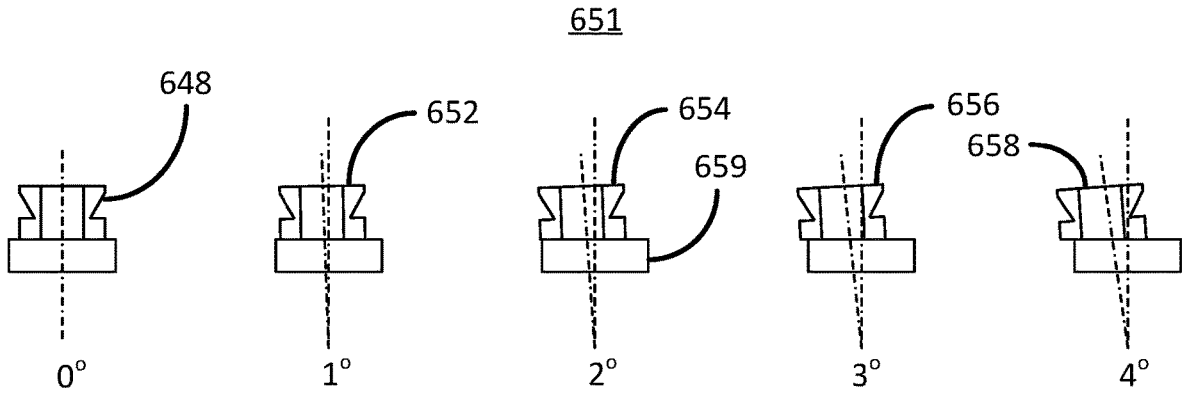

FIG. 7I illustratively depict front view line drawings of the digital pronate/supinate platforms 651 of FIG. 7H consistent with embodiments of the present invention. As shown, each of the fore/aft dovetails 648, 652, 654, 656, and 658 are shifted in degrees on the digital platform base 659. Certain embodiments envision the digital pronate/supinate platform 651 being constructed from a unitary piece of material, such as metal, polymer, nylon, carbon fiber composite, glass filled composite, or other materials known to those skilled in the art having functions applicable to that within the scope and spirit of the present invention. While other embodiments envision the digital pronate/supinate platforms 651 being comprised of multiple parts with common or optionally different materials. When in view of FIGS. 6A-6E, it should be appreciated that the skate blade and runner 100/300 will effectively be angled in a desired pronate/supinate angle relative to an ice skating boot sole 680 with each digital pronate/supinate platform 651 (648, 652, 654, 656, and 658) employed with the standalone interlocking mount 400A.

Figure 7J:
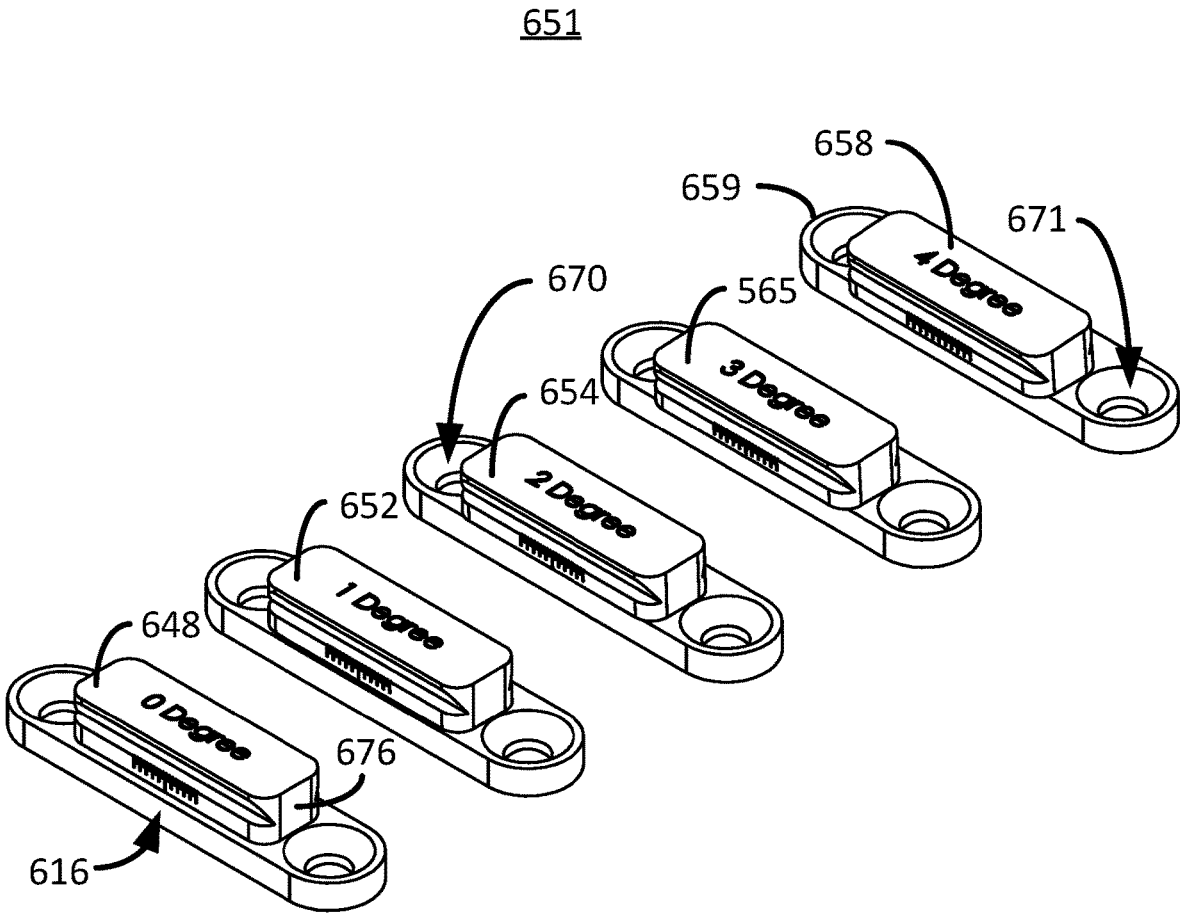

FIG. 7J illustratively depict isometric line drawings of the digital pronate/supinate platforms 651 as shown in FIGS. 7H and 7I. In this embodiment, each fore/aft digital dovetail 648, 652, 654, 656, and 658 possesses fore/aft graduated indicia 616 visibly displayed just underneath the respective fore/aft dovetail 648, 652, 654, 656, and 658. The digital fore/aft digital dovetails 648, 652, 654, 656, and 658 are envisioned to seamlessly cooperate with a bi-directional locking dovetail module 700 discussed below in conjunction with FIGS. 8A-8D.

Certain embodiments envision the digital pronate/supinate platforms 651 not having the dovetails (648, 652, 654, 656, and 658), but rather extending directly into the ice-skating boot sole 680. This would effectively restrict the degree of freedom for the ice skate (boot 699 and skate blade 100) to the incremental pronation and supination directions a.

Figure 8A:
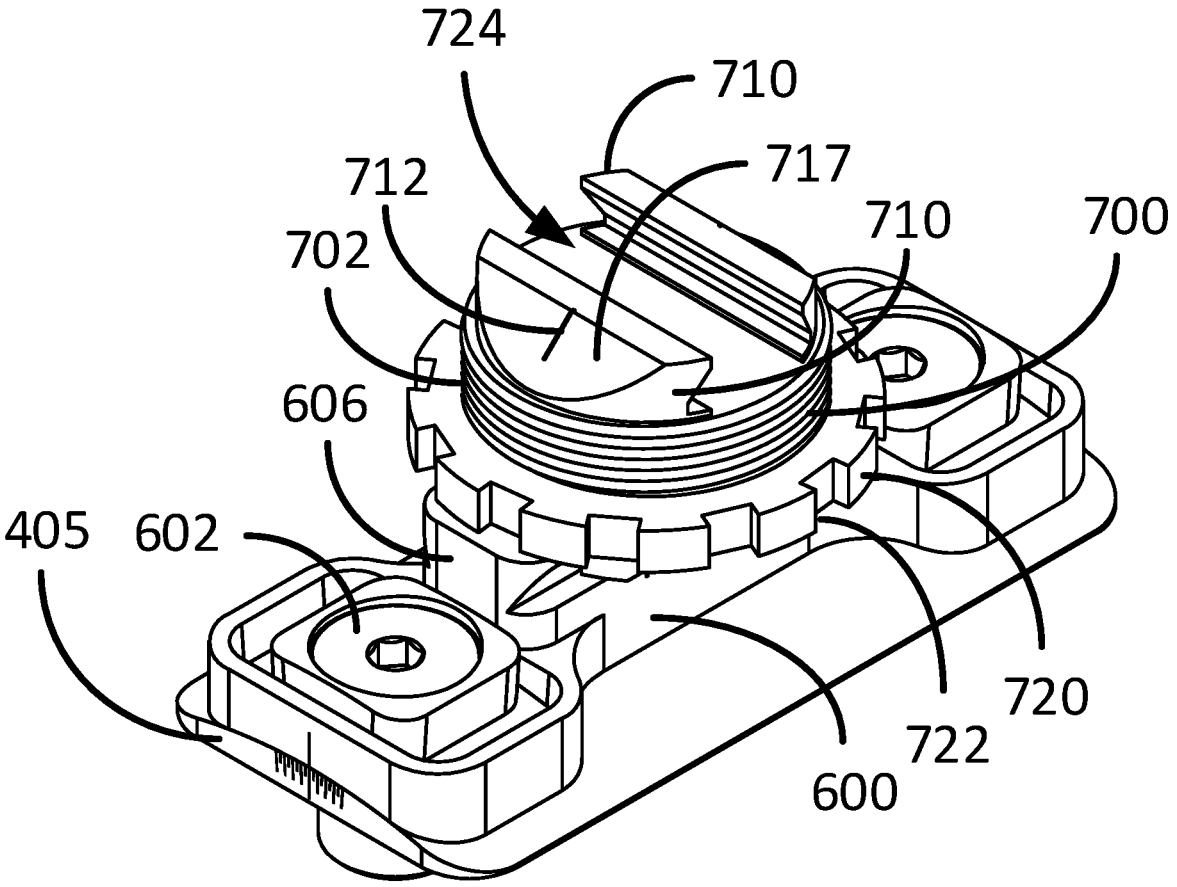
FIGS. 8A-8D illustratively depict line drawings of a bi-directional locking dovetail module embodiment in a neutral position consistent with embodiments of the present invention.
Figure 8B:
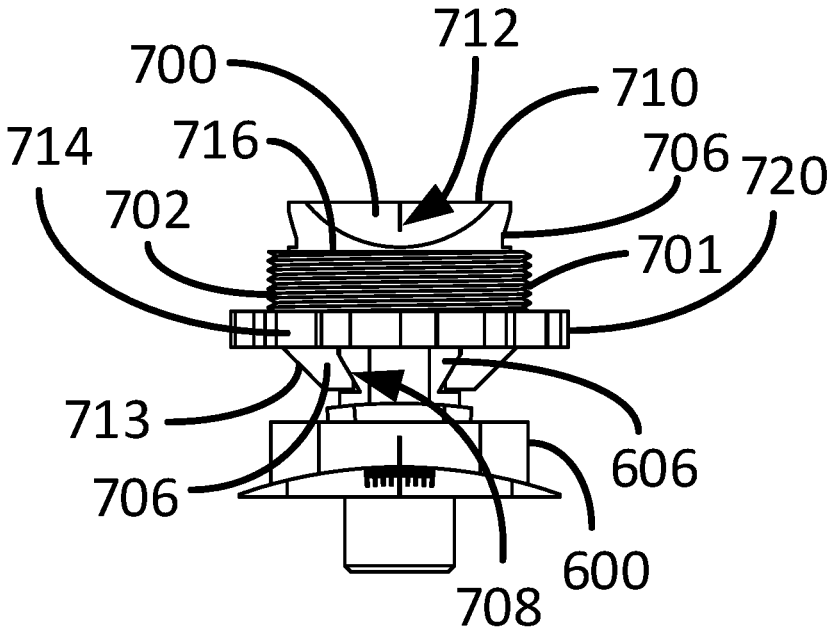

FIGS. 8A-8D illustratively depict line drawings of a bi-directional locking dovetail module embodiment in a neutral position consistent with embodiments of the present invention. FIG. 8A in view of FIG. 8B illustratively depicts an isometric line drawing of a bi-directional locking dovetail module 700 coupled with (i.e., engaged in a cooperating relationship) a pronate/supinate platform 600 in a neutral position with respect to the connected mounting plate 405. Though not shown here, other certain embodiments contemplate the bi-directional locking dovetail module 700 coupled with a digital pronate/supinate platform 651 without any modification. With continued reference to FIGS. 8A and 8B, the bi-directional locking dovetail module 700 includes a threaded cylinder 702 with a fore/aft dovetail channel 708 on the bottom side 714 of the threaded cylinder 702. The bi-directional locking dovetail module 700 further includes a side by side, or side/side, dovetail channel 724 extending from the top side 716 of the threaded cylinder 702. The side/side dovetail channel 724 is approximately 90° offset from the fore/aft dovetail channel 708. The fore/aft dovetail channel 708 is shown engaged with the fore/aft dovetail 606 on the pronate/supinate platform 600 in a female to male relationship. As mentioned, the side/side dovetail channel 724 runs, or otherwise extends, approximately 90 degrees from the fore/aft dovetail 606, facilitating side by side motion of a mating side/side dovetail 804, further described in FIGS. 9A-9J. The side/side dovetail channel 724 is defined by a pair of upper wedged shaped walls 710. Likewise, a pair of lower wedged shaped walls 706 defines the fore/aft dovetail channel 708. As depicted, a lower threaded ring 720 is cooperatively engaged with the threaded cylinder 702. As the lower threaded ring 720 is tightened against the fore/aft dovetail top 613 of the pronate/supinate platform 600, the bi-directional locking dovetail module 700 becomes locked in a desired fore/aft position by way of contact compression between the fore/aft dovetail 606 and the side walls 706 that comprise the fore/aft dovetail channel 708. In other words, the fore/aft dovetail 606 and the fore/aft dovetail channel 706 are frictionally held/constrained together when mated under compression. Certain embodiments envision the lower threaded ring 720 tightened by a human hand, but optionally could be tightened with a tool, such as a wrench (not shown). In some embodiments, the lower threaded ring 720 possesses grips 722 to assist in tightening down or loosening up the lower threaded ring 720 from engagement with the fore/aft dovetail top 613. Accordingly, in this embodiment the bi-directional module 700 can be adjusted in a desired fore or aft position by sliding the fore/aft dovetail 606 inside of the fore/aft dovetail channel 706 when the lower threaded ring 720 it is not tightened down against the fore/aft dovetail top 613.

FIG. 8B illustratively depicts a front view line drawing of the bi-directional locking dovetail module 700 consistent with embodiments of the present invention. In this figure, the fore/aft dovetail channel 708 is engaged with the fore/aft dovetail 606 on the pronate/supinate platform 600 in a female to male relationship. As the lower threaded ring 720 is twisted downwards along the cylinder threads 701 against the fore/aft dovetail top 613, the pair of lower wedged shaped walls 706, that form the fore/aft dovetail channel 708, pull against the fore/aft dovetail 606. This creates a contact compression which effectively locks the opposing dovetail components 706 and 606 together so that they are frictionally constrained in place, i.e., in the desired locked position. Also shown here is a side/side centerline pointer 712, which is located on the outside of at least one of the lower wedged shaped walls 706 (which in some embodiments are on both the outer portion 713 of the lower wedge shaped walls 706) for improved viewing by an onlooker.

Figure 8C:
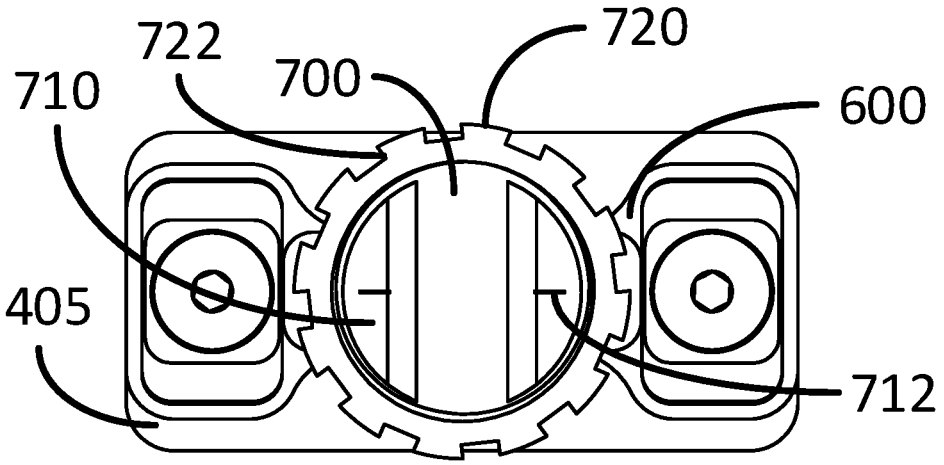
Figure 8D:
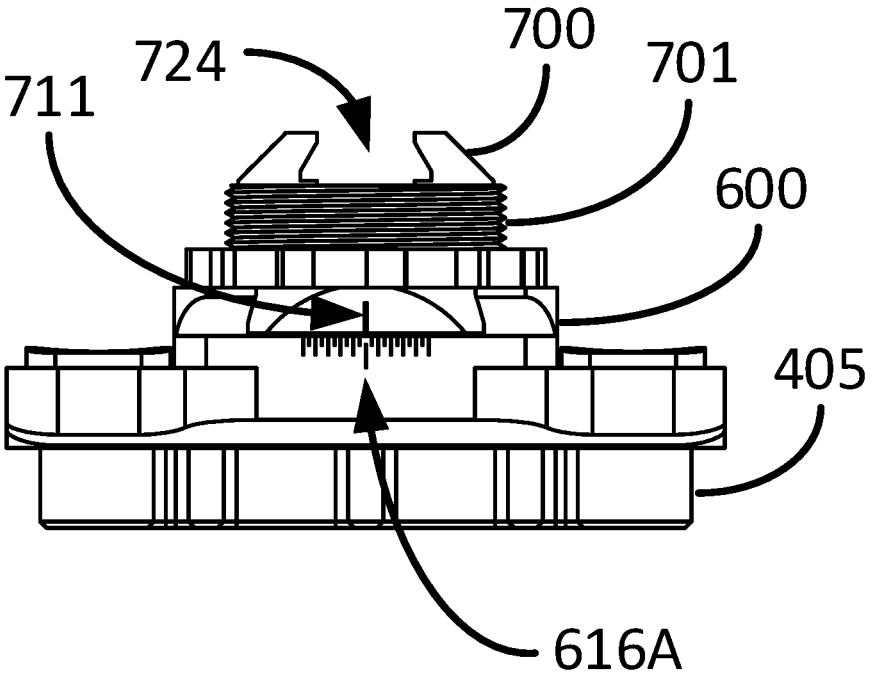

FIG. 8C illustratively depicts a top view line drawing of the bi-directional locking dovetail module 700 engaged with the pronate/supinate platform 600 in a neutral position with respect to the connected mounting plate 405 consistent with embodiments of the present invention. FIG. 8D illustratively depicts a side view line drawing of the bi-directional locking dovetail module 700 engaged with the pronate/supinate platform 600 in a neutral position consistent with embodiments of the present invention. The neutral position is indicated by the fore/aft centerline 711 lining up with the center fore/aft graduated indicium 616A.

Figure 8E:
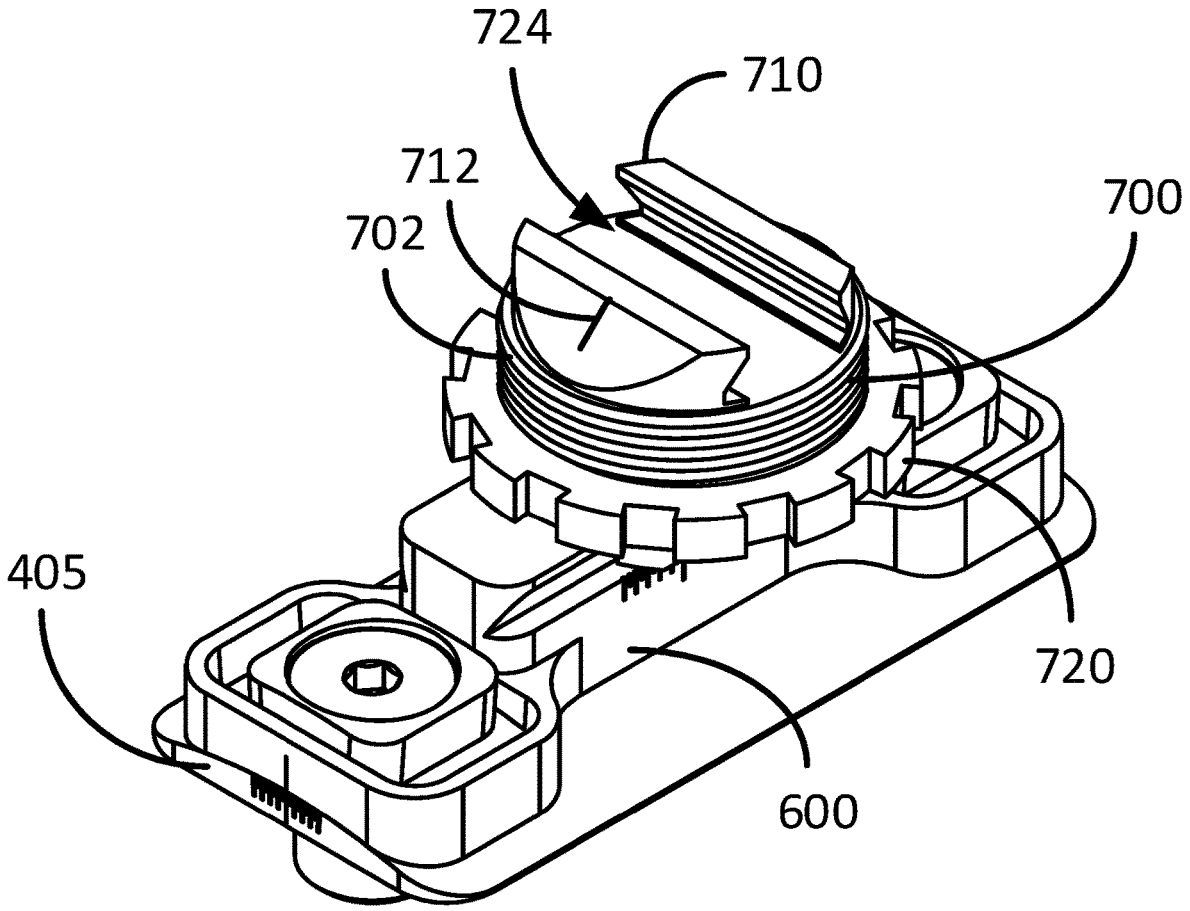
FIGS. 8E-8G illustratively depict line drawings of the bi-directional locking dovetail module 700 adjusted enough front (fore) position consistent with embodiments of the present invention.
Figure 8F:
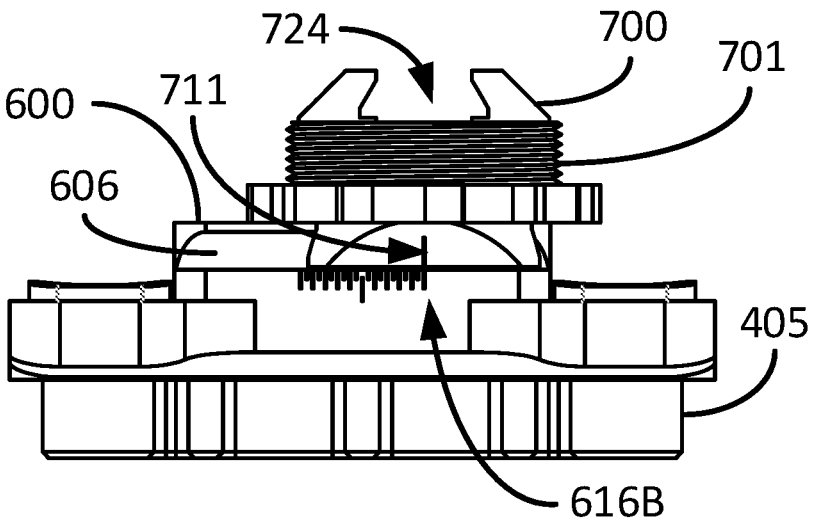
Figure 8G:
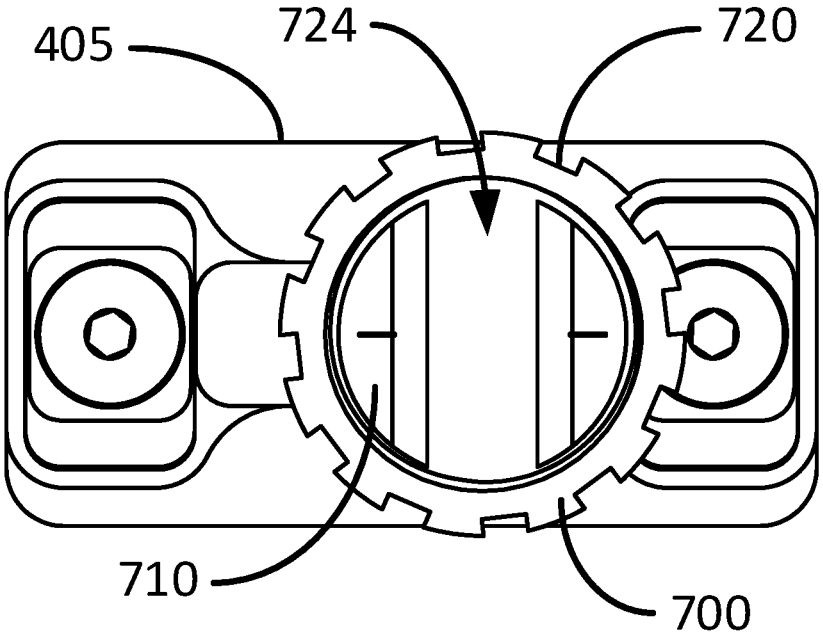

FIGS. 8E-8G illustratively depict line drawings of the bi-directional locking dovetail module 700 adjusted in a front (fore) position consistent with embodiments of the present invention. FIG. 8E is an isometric view of the bi-directional locking dovetail module 700 moved/adjusted all the way forward on the pronate/supinate platform 600. As discussed previously, the lower threaded ring 720 can be loosened to facilitate easy movement of the fore/aft dovetail channel 706 sliding over the fore/aft dovetail 606. Once in a desired forward position, the lower threaded ring 720 can be tightened to compress against the fore/aft dovetail top 613 thereby effectively locking the fore/aft dovetail 606 against the fore/aft dovetail channel 706 in position. In the present embodiment, there is no stop on either end of the fore/aft dovetail 606 facilitating a quick release of the skate runner 300 and blade 100 if the bi-directional locking module 700 is moved beyond engagement with the pronate/supinate platform 600. In other words, the fore/aft dovetail channel 706 is simply slid away from the fore/aft dovetail 606 causing the bi-directional locking module 700 to disengage with the pronate/supinate platform 600. When both of the front and the rear bi-directional locking modules 700A and 700B (see FIGS. 6A and 6E) are disengaged with their respective pronate/supinate platforms 600 the skate blade and runner 100/300 will effectively disengage with the ice-skate boot 699 that is connected to the front and rear multi-degree of freedom arrangements 660 and 670. This creates a "quick release" method of removing the runner from the boot.

FIG. 8F shows a side view line drawing of the bi-directional locking dovetail module 700 adjusted in the front position as indicated by the fore/aft centerline 711 lining up with the far right fore/aft graduated indicium 616B. FIG. 8G depicts a top view of the bi-directional locking dovetail module 700 engaged with the pronate/supinate platform 600 in the front position with respect to the connected mounting plate 405. When both of the front and the rear bi-directional locking modules 700A and 700B are moved together in a forward position, the skate blade and runner module 100/300 is effectively adjusted forward, accommodating a skater's desired fore/aft blade 100/300 position.

Figure 8H:
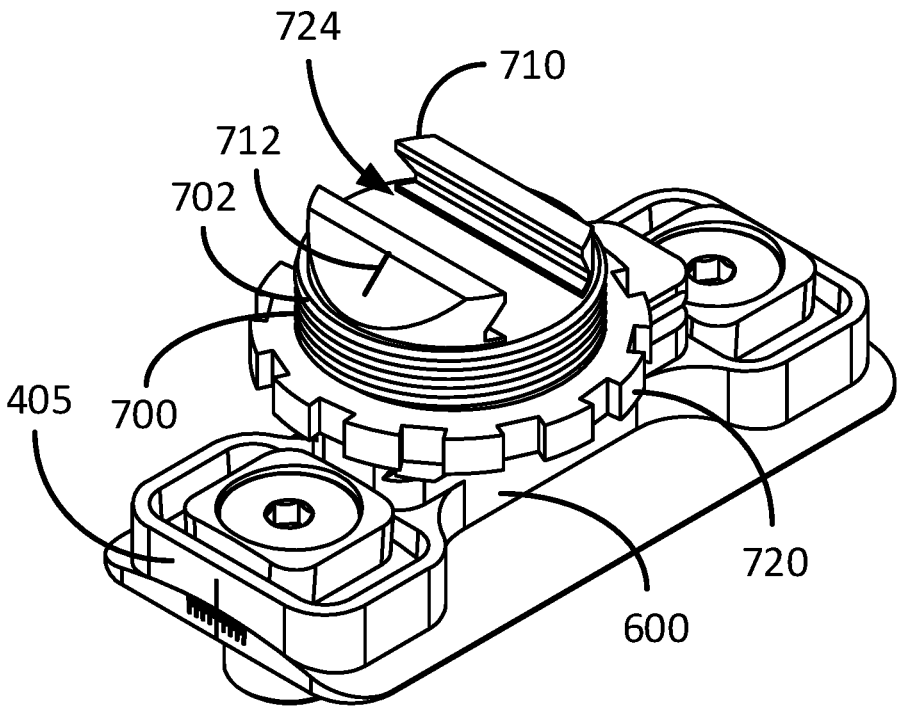
FIG. 8H-8J illustratively depict line drawings of the bi-directional locking dovetail module 700 adjusted enough back (aft) position consistent with embodiments of the present invention.
Figure 8I:
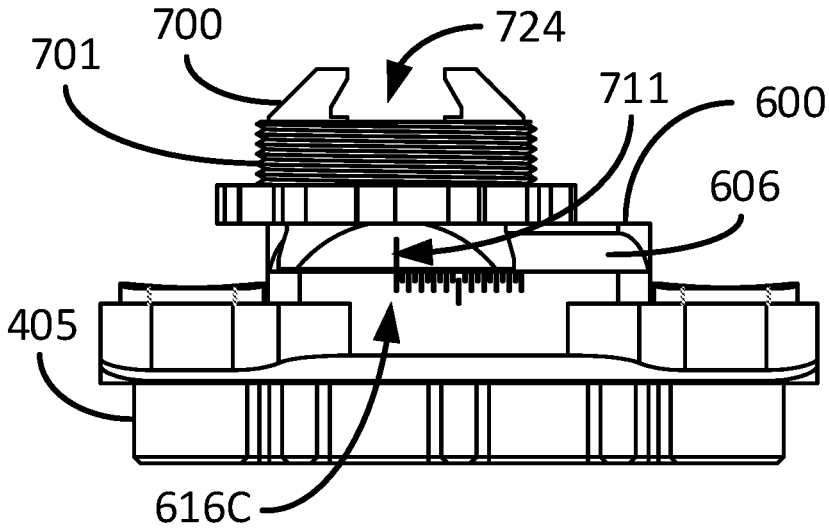
Figure 8J:
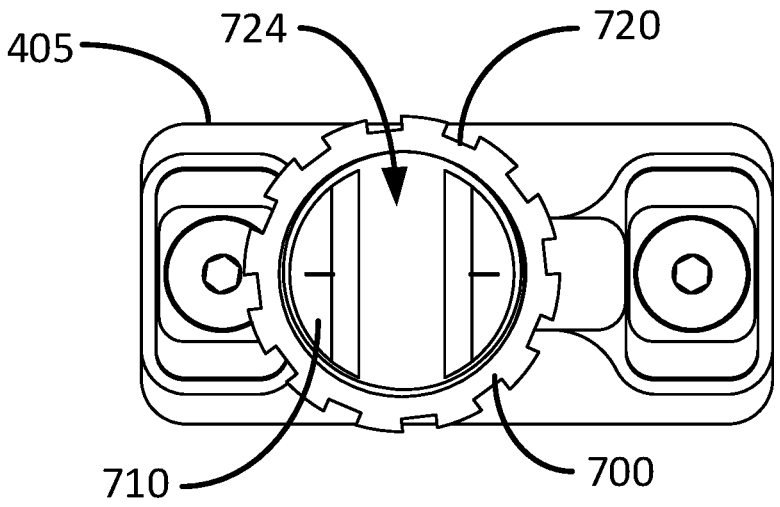

FIGS. 8H-8J illustratively depict line drawings of the bi-directional locking dovetail module 700 adjusted enough back (aft) position consistent with embodiments of the present invention. FIG. 8H is an isometric view of the bi-directional locking dovetail module 700 moved/adjusted all the way back on the pronate/supinate platform 600. FIG. 8F shows a side view line drawing of the bi-directional locking dovetail module 700 adjusted in the back position as indicated (for the benefit of an onlooker) by the fore/aft centerline 711 lining up with the far right fore/aft graduated indicium 616C. FIG. 8G shows a top view of the bi-directional locking dovetail module 700 engaged with the pronate/supinate platform 600 in the back/rear position with respect to the connected mounting plate 405. When both of the front and the rear bi-directional locking modules 700A and 700B are moved together in a back position, the skate blade and runner module 100/300 is effectively adjusted backwards, accommodating a skater's fore/aft skate blade 100/300 position. In the present embodiment, there is no stop on the back of the fore/aft dovetail 606, which enables/allows for the quick release of the skate blade and runner 100/300 when the bi-directional locking module 700 is loosened and in some embodiments is disengaged with the pronate/supinate platform 600. As previously mentioned, when both of the front and the rear bi-directional locking modules 700A and 700B (see FIGS. 6A and 6E) are disengaged with their respective pronate/supinate platforms 600, the skate blade and runner 100/300 will also effectively be disengaged with the ice-skate boot 699. The ice-skate boot 699 being connected to the front and rear multi-degree of freedom arrangements 660 and 670.

An optional embodiment envisions a modified bi-directional locking dovetail module 700 engaged with the pronate/supinate platform 600 or digital pronate/supinate platforms 651 at one end, but not having the side/side channel 724 or related hardware. Rather, the optional embodiment of the modified bi-directional locking dovetail module is envision to extend and attach directly into the ice-skating boot sole 680. This would effectively restrict the degree of freedom for the ice skate (boot 699 and skate blade 100) to the supination directions a and the fore and aft directions $X_1$ and $X_2$. It should be appreciated that when any of the elements are locked into place, those locked elements essentially become a rigid skate post. Hence, if the bi-directional locking dovetail module 700 is locked onto the pronate/supinate platform 600, the two elements 600 and 700 functionally resemble a rigid post element. If the side/side locking dovetail module 800 is not locked down but the two elements 600 and 700 are locked down it is the equivalent of having a rigid post that only provides side-by-side motion.

Figure 8K:
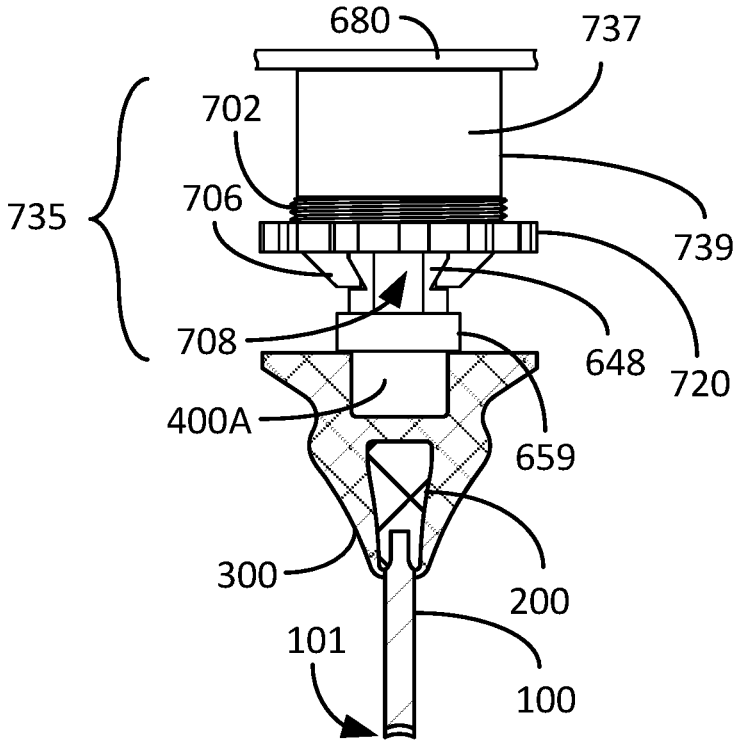
FIG. 8K illustratively depicts a front view line drawing of an alternate quick release embodiment consistent with embodiments of the present invention.

FIG. 8K illustratively depicts a front view line drawing of an alternate quick release embodiment consistent with embodiments of the present invention. It should be clear that each degree of freedom described herein (e.g., $Y_1$, $X_1$, $Z_1$, $\Phi_1$, $\alpha$) can be employed independently in a modified post arrangement particular to a specific degree of freedom. It should also be clear that more than one degree of freedom described herein, but less than all degrees of freedom described herein can be employed as desired in yet a different particular post arrangement. FIG. 8K is an example of a modified post arrangement particular to the specific degree of freedom $X_1$ or $X_2$.

FIG. 8K shows one such embodiment where there is a single moving part in post arrangement 735. In the present post arrangement 735 embodiment, the standalone male interlocking mount 400A is bonded or otherwise fixedly attached into the skate overmold 300. The digital platform base 659 of a digital neutral angled fore/aft dovetail 648 is fixedly connected to the male interlocking mount 400A via a pair of threaded bolts (not shown). More specifically, the threaded bolts (not shown) are fixedly engage the threaded through-holes 432 in the pair of standalone threaded cylinders 402A by way of the two platform through-holes 671 on either side of the digital platform base 659. The digital neutral angled fore/aft dovetail 648 (used in this example) cooperates with the fore/aft dovetail channel 708 located at the bottom part of the modified fore/aft post arrangement 739. The modified fore/aft post arrangement 739 possesses a threaded cylinder 702 at the bottom of the post 737 with a cooperating threaded ring 720 that can lock the fore/aft dovetail and channel 748 and 708 together, as previously described. The post 737 connects directly to an ice-skate boot sole 680, as shown. When the threaded ring 720 is loosened, the skate blade and runner 100/300 disengages with the modified fore/aft post arrangement 739. One can appreciate that different digital fore/aft dovetails 652, 654, 656, and 658 or some other attachment means to the skate blade and runner 100/300 can be used without departing from the scope and spirit of this embodiment.

Figure 9A:
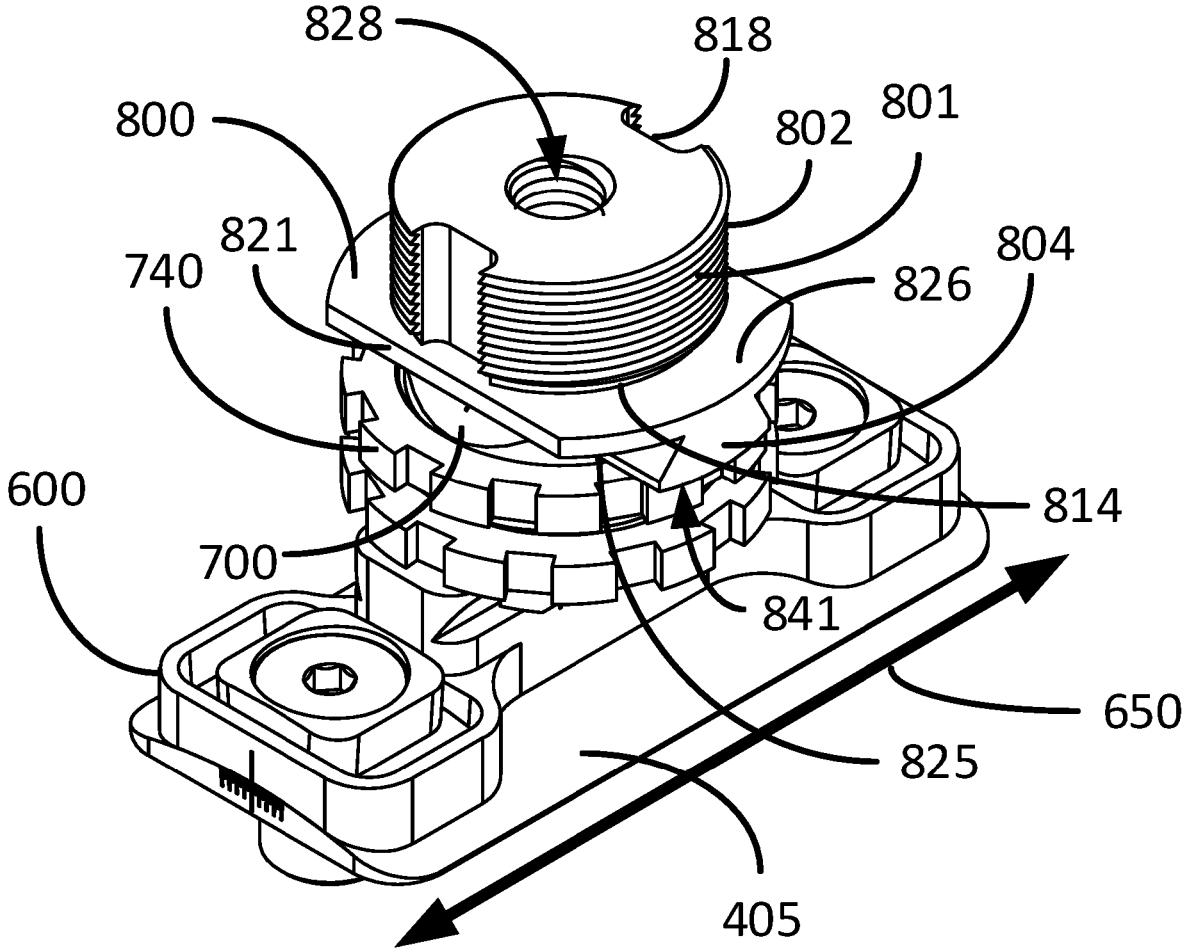
FIGS. 9A-9E illustratively depict line drawings of a side/side dovetail module embodiment engaged with a bi-directional locking dovetail module in a neutral position consistent with embodiments of the invention.
Figure 9B:
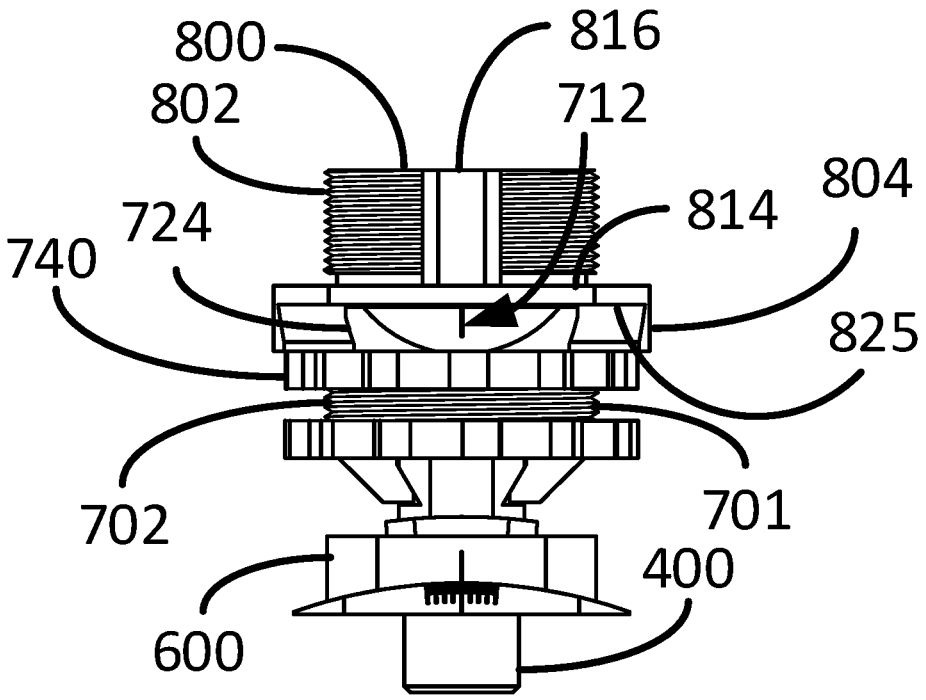

FIGS. 9A-9E illustratively depict line drawings of a side/side dovetail module embodiment engaged with a bi-directional locking dovetail module 700 in a neutral position consistent with embodiments of the invention. FIG. 9A in view of FIG. 9B shows a side/side dovetail locking module 800 connected to a bi-directional locking dovetail module 700 by way of a side/side dovetail 804 matingly engaged with the side/side dovetail channel 724. The side/side dovetail module 800 generally comprises a side/side dovetail 804 that extends from a bottom side 814 of a threaded cylinder 802. In the present embodiment, screw threads 801 run concentrically along the length of the threaded cylinder 802 from the threaded cylinder top 816 to the threaded cylinder bottom 814, however other embodiments envision the threads 801 not extending to the threaded cylinder top 816 or bottom 814. A plate 826 located at the threaded cylinder bottom 814 at least partially extends beyond the diameter of the threaded cylinder 802, which in the present embodiment is not fully circular to allow human fingers to access a middle threaded ring 740. Certain embodiments envision the plate 826 defined as a circular plate with two parts of the circle removed along parallel cuts 821. The side/side dovetail 804 extends in a downward direction from the plate bottom 825, as shown. There is at least one lift ring orientation recess 818 that can be a flat, a channel (as shown in the present embodiment), or some other kind of orientation recess that accomplishes a similar function within the scope and spirit of the present invention. The present embodiment depicts two lift ring orientation recesses 818 configured to engage a lift ring 900, discussed below. Running concentrically through the side/side locking dovetail module 800 is a threaded bolt hole 828 that is configured to connect with the threaded top bolt 672 to lock an ice-skate sole 680 to the front and rear multi-degree of freedom arrangements 660 and 670. In the present embodiment, the side/side dovetail module 800 is configured to move essentially perpendicular (in a non-arced manner) to the contact axis 650.

FIG. 9B illustratively depicts a front view line drawing of the side/side locking dovetail module 800 embodiment connected with the bi-directional locking dovetail module 700 embodiment consistent with embodiments of the present invention. The bi-directional locking dovetail module 700 includes a middle threaded ring 740 screwed onto the threaded cylinder 702, which facilitates locking the side/side dovetail module 800 in a desired side adjustment. More specifically, the side/side dovetail 804 (which extends from the bottom portion 825 of the side/side dovetail module 800) is engaged with the side/side dovetail channel 724 in a sliding/cooperating relationship. When the middle threaded ring 740 is twisted upwardly along the threads 701, the middle threaded ring 740 contacts the side/side dovetail bottom 841. As the middle threaded ring 740 is twisted to compress against the side/side dovetail bottom 841, the side/side dovetail module 800 will be locked into a desired side/side position by way of contact compression between the side/side dovetail 804 and the pair of upper wedged shaped walls 710 that form the side/side dovetail channel 724. In this manner, the side/side dovetail 804 and the side/side dovetail channel walls 710 are frictionally constrained together in place when mated under compression. Certain embodiments envision the middle threaded ring 740 tightened by a human hand, but optionally could be tightened with a tool, such as a wrench. In some embodiments, the middle threaded ring 740 possesses grips 722 to assist in tightening down or loosening up the middle threaded ring 740. Accordingly, in this embodiment the side/side module 800 can be adjusted in a desired side/side position by sliding the side/side dovetail 804 inside of the side/side dovetail channel 724 when the middle threaded ring 740 it is not tightened down against the side/side dovetail bottom 841 fore/aft dovetail top 613. Also shown here is a side/side centerline pointer 712, which is located on at least one of the outer surfaces 717 of the lower wedged shaped walls 710. The outer wall surface 717 is angled for improved viewing by an onlooker.

Figure 9C:
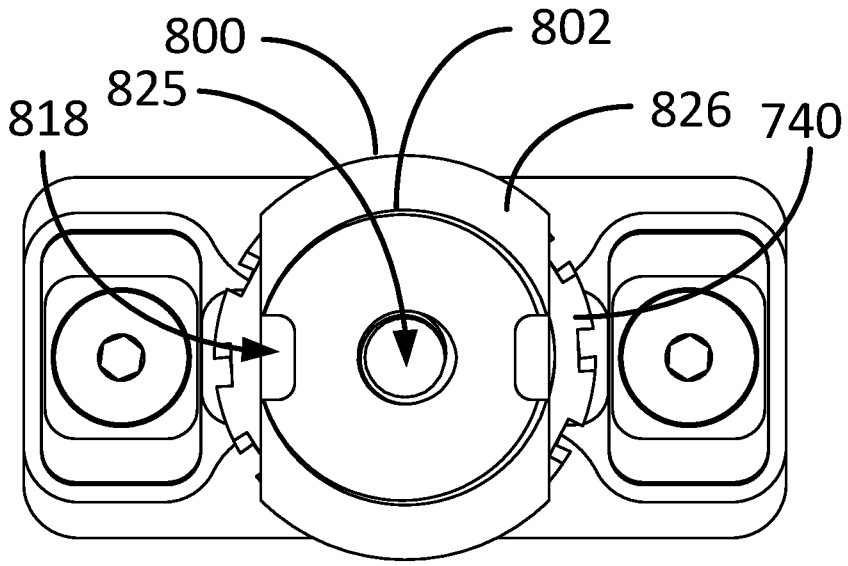
Figure 9D:
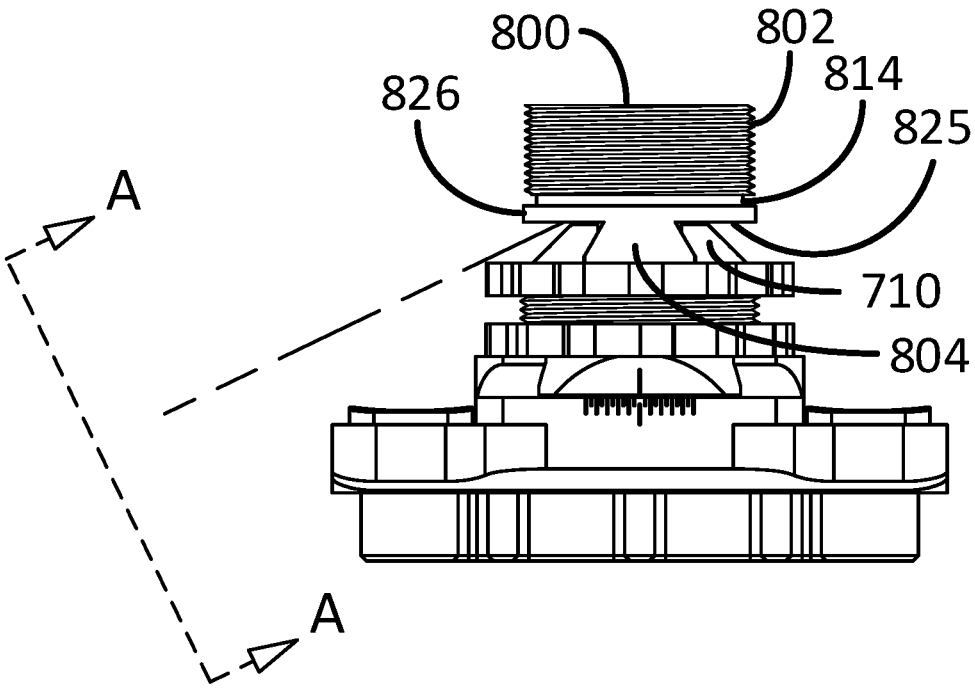
Figure 9E:
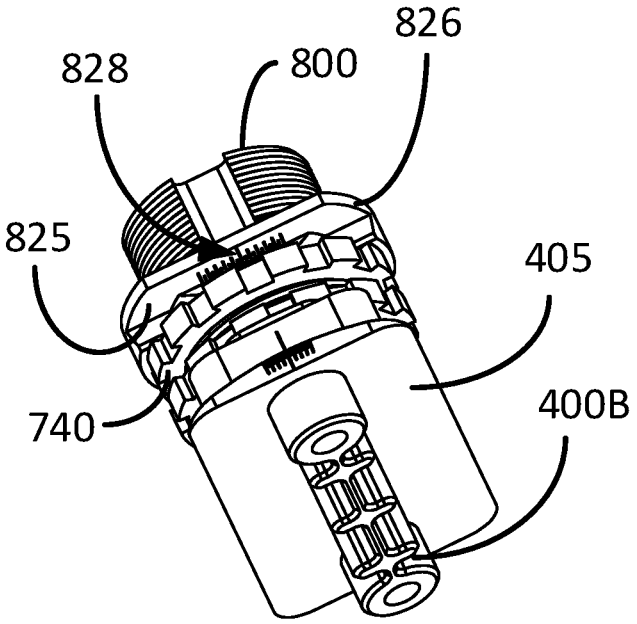

FIG. 9C illustratively depicts a top view line drawing of the side/side locking dovetail module 800 engaged with the bi-directional locking dovetail module 700 in a neutral position with respect to the connected mounting plate 405 consistent with embodiments of the present invention. FIG. 9D illustratively depicts a side view line drawing of the side/side locking dovetail module 800 with a defined view A-A depicted as an upward line of sight. The upward line of sight direction A-A allows an onlooker to see the plate bottom 825 without obstruction. FIG. 9E illustratively depicts the perspective the side/side locking dovetail module 800 from the A-A sight direction view. As shown, side/side graduated indicia 828 are visibly disposed on at least one side of the plate bottom surface 825 (if not on either side of the side/side dovetail 804 on the plate bottom surface 825). The side/side centerline pointer 712 is configured to point or otherwise line up with the side/side graduated indicia 828 to indicate the side-by-side position of the side/side locking dovetail module 800 relative to the bi-directional locking dovetail module 700.

Figure 9F:
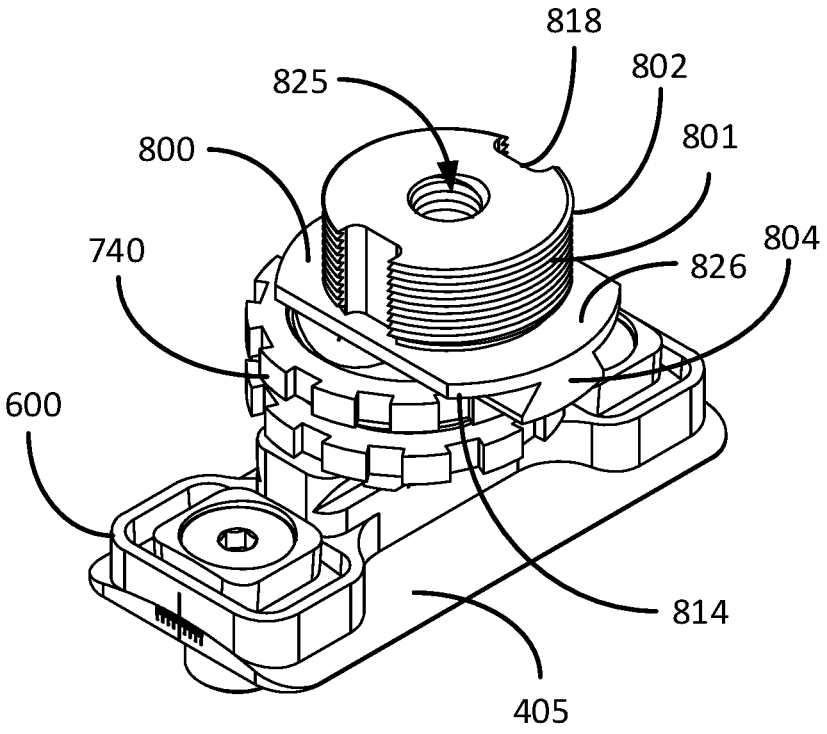
FIGS. 9F-9H illustratively depict line drawings of the side/side locking dovetail module adjusted to the far right position consistent with embodiments of the present invention.
Figure 9G:
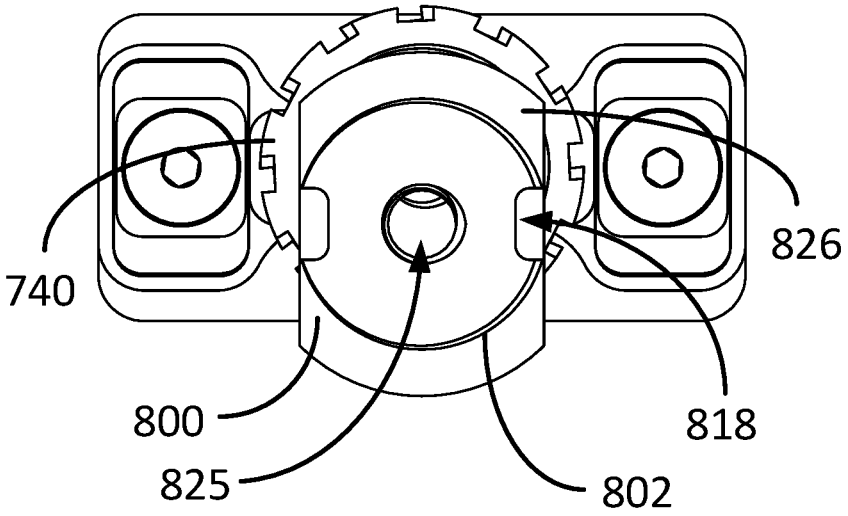
Figure 9H:
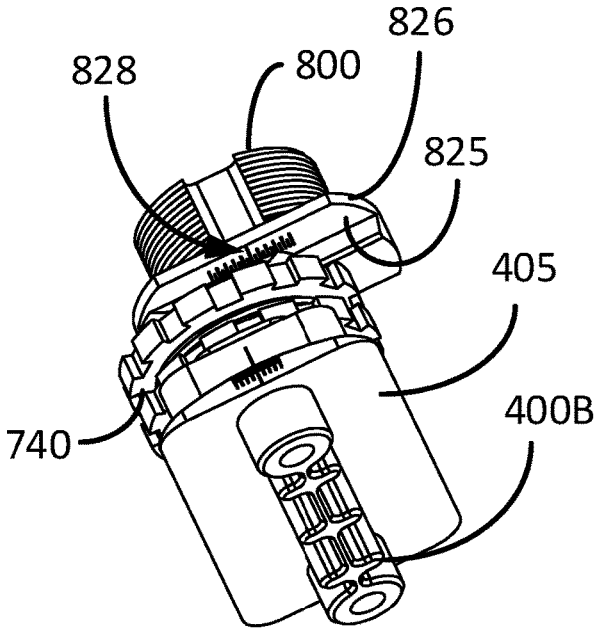

FIGS. 9F-9H illustratively depict line drawings of the side/side locking dovetail module 800 adjusted to the far right position consistent with embodiments of the present invention. FIG. 9F is an isometric view of the side/side locking dovetail module 800 moved/adjusted to the far right. As discussed previously, the middle threaded ring 740 can be loosened so that it is not compressed against the side/side dovetail bottom 841 facilitating easy movement of the side/side dovetail channel 724 sliding over the side/side dovetail 804. Once in a desired forward position, the middle threaded ring 740 can be tightened to compress against the side/side dovetail bottom 841 thereby effectively locking the side/side dovetail 804 in the side/side channel 724. FIG. 9G illustratively shows a top view of the side/side locking dovetail module 800 moved to the far right. FIG. 9H illustratively depicts a perspective view of the side/side locking dovetail module 800 from the A-A line of sight. As shown, side/side graduated indicia 828 are visibly disposed on at least the plate bottom surface 825. The side/side centerline pointer 712 is configured to point, or otherwise line up, with the side/side graduated indicia 828 to indicate the far right side position. One skilled in the art will appreciate that the side/side locking dovetail module 800 can be adjusted in any number of positions within the bounds of the side/side graduated indicia 828 with respect to the bi-directional locking dovetail module 700.

Figure 9I:
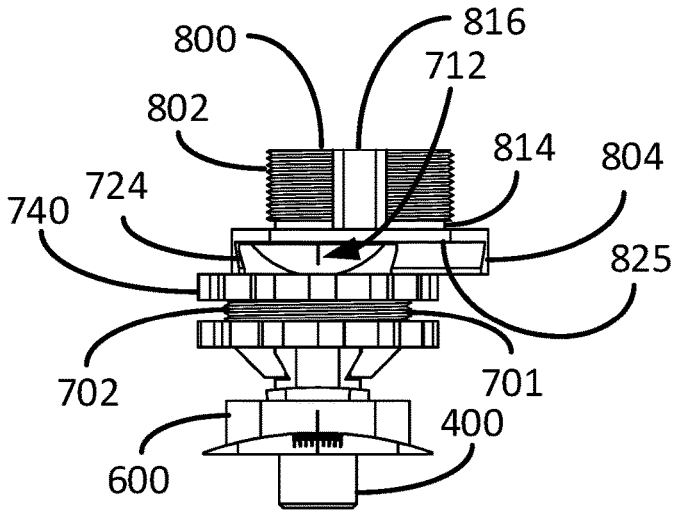
FIGS. 9I and 9J show the side/side centerline pointer indicating that the side/side locking dovetail module is moved to the far right and far left, respectively.
Figure 9J:
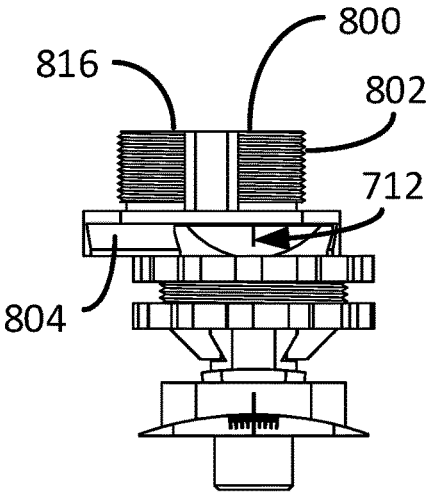

FIG. 9I shows the side/side centerline pointer 712 pointing to the side/side graduated indicia 828 (not seen in this view) indicating that the side/side locking dovetail module 800 is moved to the far right. FIG. 9J shows the side/side centerline pointer 712 pointing to the side/side graduated indicia 828 (not seen in this view) indicating that the side/side locking dovetail module 800 is moved to the far left. When in FIGS. 9I and 9J are considered in light of FIGS. 6A-6E, it should be appreciated that the skate blade and runner 100/300 will effectively be shifted, or otherwise moved, in a desired side offset position relative to an ice skating boot 699.

An optional embodiment envisions a modified side/side locking dovetail module 800 engaged with the bi-directional locking dovetail module 700 that is engaged with the pronate/supinate platform 600 or digital pronate/supinate platforms 651. The modified side/side locking dovetail module is envisioned not to connect with a Z height changing elements but rather to attach directly into the ice-skating boot sole 680. This would effectively restrict the degree of freedom for the ice skate (boot 699 and skate blade 100) to the supination directions $\alpha$, and the fore and aft directions $X_1$ and $X_2$, and the side by side directions $Y_1$ and $Y_2$.

FIGS. 10A-10F illustratively depict line drawings of a lift ring embodiment cooperating with the side/side locking dovetail module 800 consistent with embodiments of the present invention. FIG. 10A is an isometric line drawing illustratively depicting the lift ring 900 essentially encircling the threaded cylinder 802 of the side/side locking dovetail module 800. In the present embodiment, the lift ring top surface 902 has a concave arc 907 to accommodate an arced ice-skate sole 680 when adjusting in the fore/aft directions ($X_1$ and $X_2$) along the sole 680. The lift ring top surface 902 interfaces with the attachment plates 665 and 675, which are inserted in the boot 699, the lift ring top surface 902 contacts or is otherwise constrained against the outside of the ice-skating boot sole 680 and therefore is above, or proper to, the threaded cylinder top 816. To accommodate moving in different positions on the sole 680, the inside of the lift ring 900 comprises two lift ring alignment keys 906 that conform and engage the lift ring orientation recesses 818 in a limited rotating relationship to essentially keep the lift ring 900 oriented in the right direction. In other words, the lift ring concave arc 907 needs to remain in the orientation as shown with some built-in wiggle room to accommodate the ice-skating boot sole 680 and/or other movement. The lift ring alignment keys 906 need only match the lift ring orientation recess 818 to keep the lift ring 900 oriented properly. Hence, if there is a single lift ring orientation recess 818 then there only needs to be a single lift ring alignment key 906, and if the lift ring orientation recess 818 is a flat then the lift ring alignment key 906 only needs to be a matching flat.

In the present embodiment, the lift ring 900 is a universal element with a constant lift ring thickness 912 that is between 0.2 inches and 0.4 inches thick. Certain embodiments envision the lift ring thickness 912 being approximately 0.25 inches thick. The lift ring 900 is adjustable in the Z direction (vertical $Z_1$ or $Z_2$ direction, see FIGS. 6B and 6C) by twisting the upper threaded ring 760 about the threaded cylinder 802, of the side/side locking dovetail module 800, in the Z direction. The lift ring bottom surface 904 interfaces or otherwise rests (by the downward force of gravity) on the upper threaded ring 760 at interface 930. The lift ring can move in the Z direction to extend the height of the front and/or rear multi-degree of freedom arrangements 660 and 670 approximately as far as the height of the threads 801 of the threaded cylinder 802.

Figure 10B:
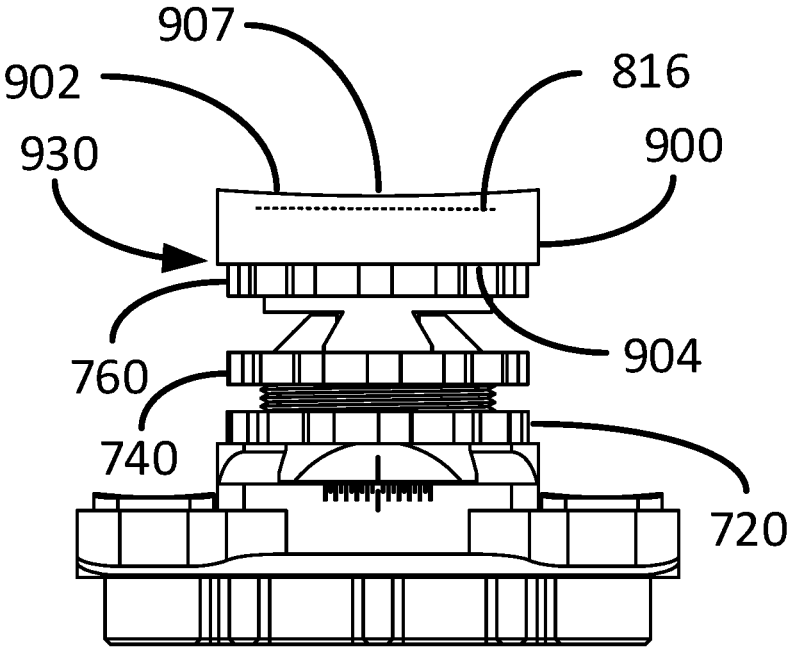
Figure 10C:
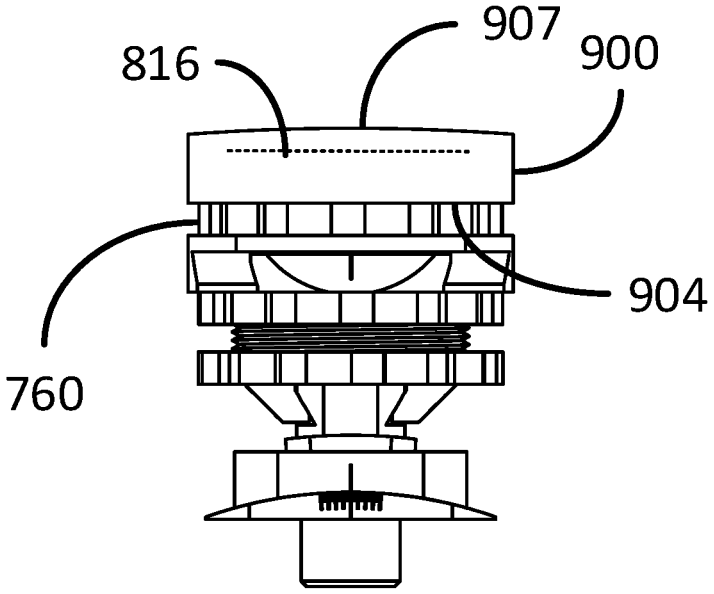
Figure 10D:
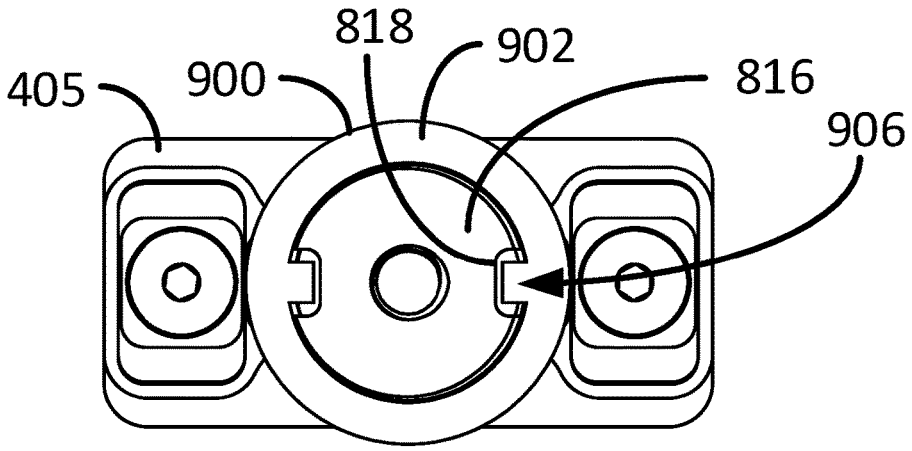

FIG. 10B illustratively depicts a side view of the lift ring 900 at a low position on the side/side locking dovetail module 800 consistent with embodiments of the present invention. The dashed lines near the lift ring top 902 represent where the threaded cylinder top 816 is positioned relative to the lift ring top 902. FIG. 10C illustratively depicts the front view of the lift ring 900 at the low position on the side/side locking dovetail module 800 consistent with embodiments of the present invention. As shown here, the lift ring top 902 appears bowed, however that is the consistent shape of the front or rear side of the concave lift ring arc 907. FIG. 10D illustratively depicts a top view line drawing of the lift ring 900 showing space between the lift ring alignment keys 906 and the lift ring orientation recesses 818 to allow for some wiggle room.

Figure 10E:
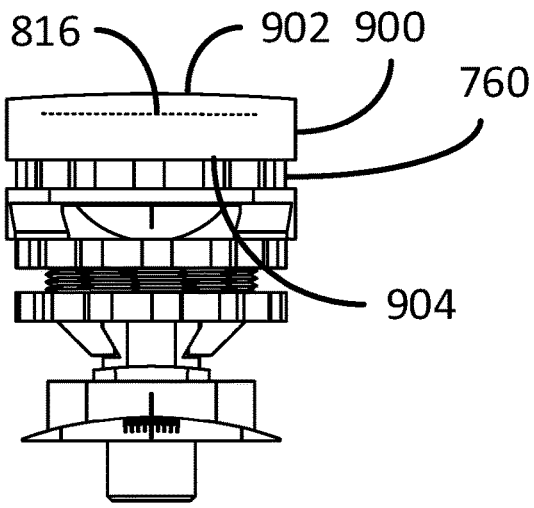
Figure 10F:
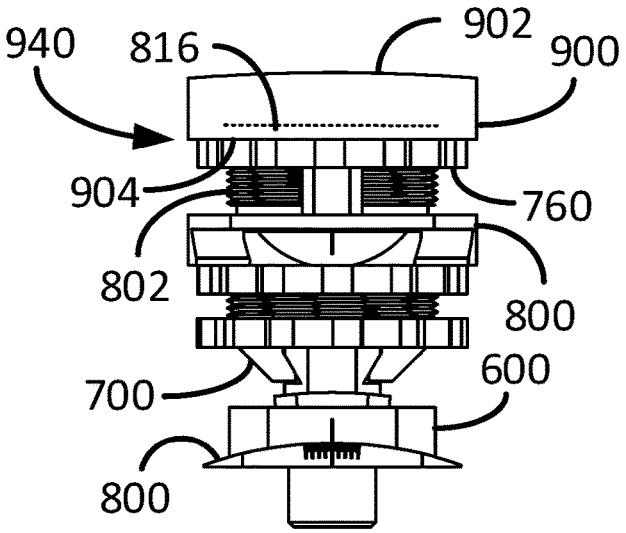

FIGS. 10E and 10F illustratively depict front view line drawings of the lift ring 900 in two different vertical positions consistent with embodiments of the present invention. As shown in FIG. 10E, the upper threaded ring 760 is in the lowest position essentially against the upper surface of plate 826 with the threaded cylinder top 816 near, but under the lift ring top 902 as depicted by the dashed lines. As a consequence of spinning the upper threaded ring 760 to move upwards in the Z (vertical) direction, the lift ring 900 is raised in a higher position denoted by the location of the threaded cylinder top 816, as depicted in FIG. 10F. Because the lift ring 900 rests on the upper threaded ring 760 at interface 940, the upper threaded ring 760 pushes the lift ring 900 upwardly or lets the lift ring 900 lower. As the lift ring 900 is moved upwards or downwards (i.e., in the +/−Z directions) the ice-skate boot sole 680 is raised or lowered relative to the skate blade and runner 100/300, which in some circumstances can accommodate a skater's level of flexibility (such as ham string flexibility) over the skate, for example.

Figure 10G:
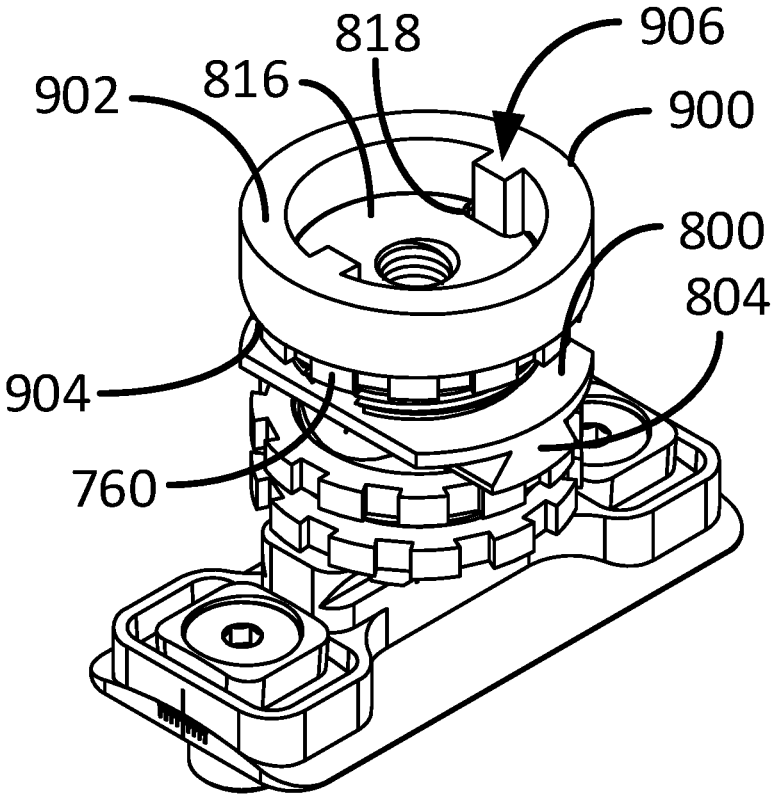

FIG. 10G illustratively depicts an isometric line drawing of the lift ring 900 and a raised vertical position consistent with embodiments of the present invention. The threaded cylinder top 816 is shown at a much lower point on the interior of the lift ring 900 as compared with FIG. 10A.

Figure 10H:
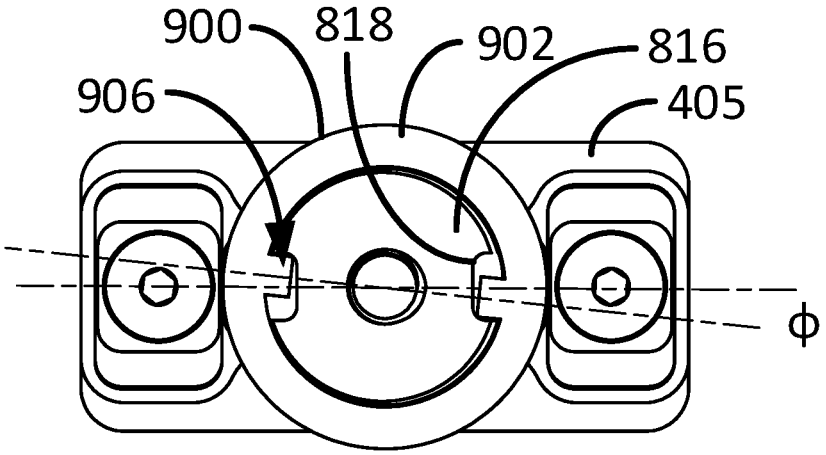

FIG. 10H illustratively shows a line drawing top view of the showing space between the lift ring alignment keys 906 and the lift ring orientation recesses 818 to allow for some wiggle room. In this embodiment, an angle of play Φ between the lift ring alignment keys 906 and the lift ring orientation recess 818 can be between 0° and 10°, however embodiments are not limited by this range and other ranges are contemplated.

Figure 11A:
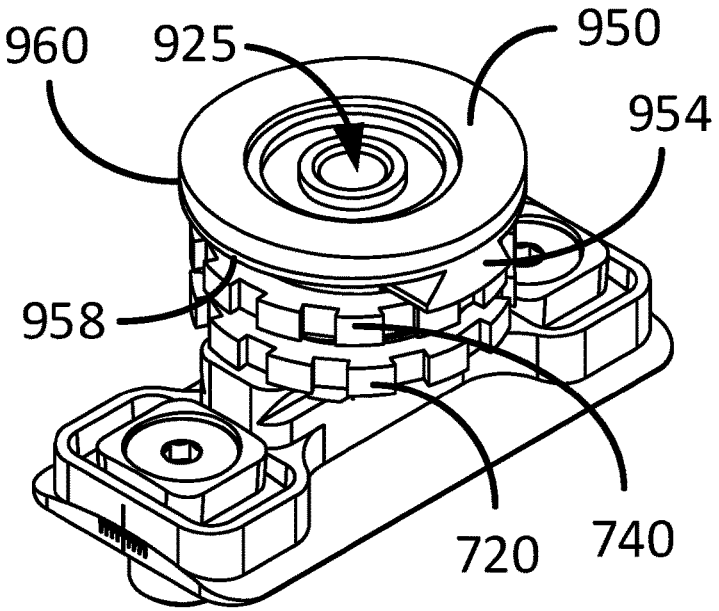
FIGS. 11A-11G illustratively depict line drawings of digital lift ring embodiments consistent with embodiments of the present invention.

FIGS. 11A-11G illustratively depict line drawings of digital lift ring embodiments consistent with embodiments of the present invention. FIG. 11A is an isometric line drawing of an alternative embodiment showing a digital lift ring system 950 that connects directly with the bi-directional locking dovetail module 700. The lift ring system 950 can include a digital lift ring 960 that cooperates with a dovetail platform 958, the dovetail platform 950 incorporating a side/side dovetail 954. The side/side dovetail 954 cooperates with the side/side dovetail channel 724 associated with the bi-directional locking dovetail module 700. Certain embodiments envision the digital lift ring system 950 comprising a plurality of different sized, independent, rings 960-970 to provide varied Z heights for changing Z height ($Z_1$ and $Z_2$) of the bi-directional locking modules 700A and 700B. Front bi-directional locking module 700A is shown with the present configuration, as an example, though both of the bi-directional locking modules 700A and 700B can be configured with the side/side locking dovetail module 800 and lift ring 900 or the digital lift ring system 950. Though the present embodiment depicts the lift ring system 950 comprising a digital lift ring 960 and a separate dovetail platform 958 with a side/side dovetail 954, certain embodiments envision a lift ring system 950 being a unitary element. The lift ring system 950 whether a unitary element or not can be made out of metal, glass filled composite, any variety of polymers, carbon composite or other rigid/semi-rigid materials known to those skilled in the art applicable for this use.

Figure 11B:
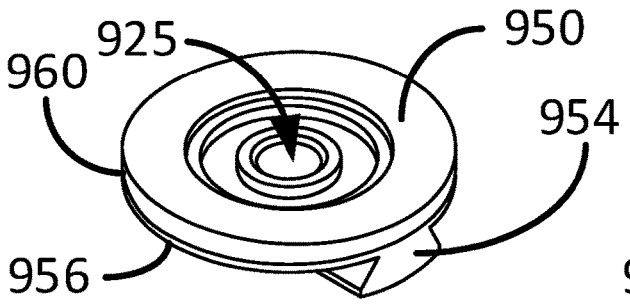
Figure 11C:
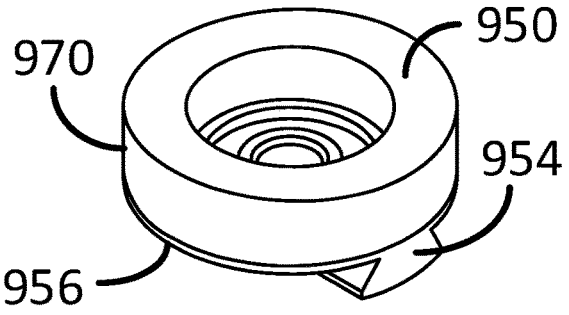

FIGS. 11B and 11C are isometric line drawings that illustratively depict lift ring system 950 with two different sized lift rings consistent with embodiments of the present invention. FIG. 11B shows a low Z height digital lift ring 960 cooperating with a dovetail platform 956. FIG. 11C shows a high Z height digital lift ring 970 cooperating with a dovetail platform 956. As shown in both FIGS. 11B and 11C, there is a center threaded hole 925 adapted to receive threaded top bolt 672 to connect the bi-directional locking modules 700A and 700B, reconfigured with the present embodiment, with an ice-skate boot sole 680.

Figure 11D:
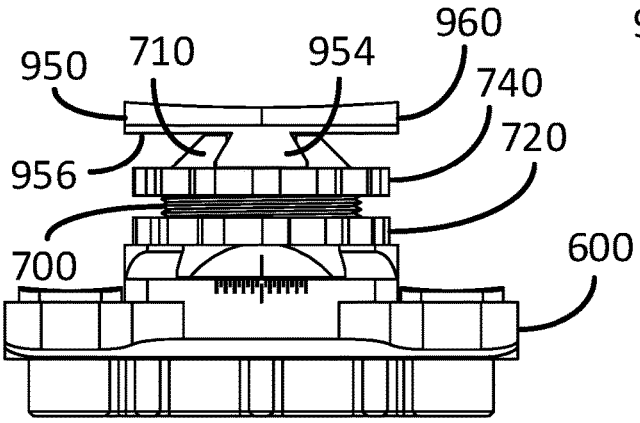
Figure 11E:
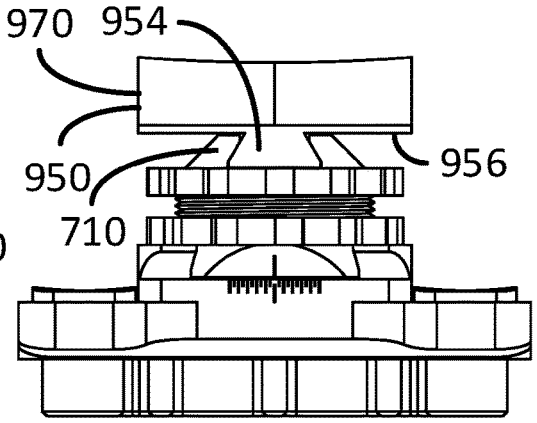

FIGS. 11D and 11E are side view line drawings that illustratively depict the bi-directional locking dovetail module 700 cooperating directly with the lift ring system 950 consistent with embodiments of the present invention. FIG. 11D shows a side view of a low Z height digital lift ring 960 wherein the digital lift ring dovetail 954 is cooperating with the side/side channel 724, which is defined by the side/side channel walls 710. As previously discussed, the side/side dovetail channel 724 engages the lift ring dovetail 954 on the lift ring system 950 in a female to male relationship. As the middle threaded ring 740 is twisted upwards along the cylinder threads 701 against the dovetail platform 956, the pair of upper wedged shaped walls 710, that form the side/side dovetail channel 724, pull against the digital lift ring dovetail 954. This creates a contact compression which effectively locks the opposing dovetail components 724 and 954 together so that they are frictionally constrained in place, i.e., in the desired locked position. FIG. 11E shows a side view of the digital lift ring system 950 with a thick lift ring 972 provides a higher Z height than that of lift ring 960.

Figure 11F:
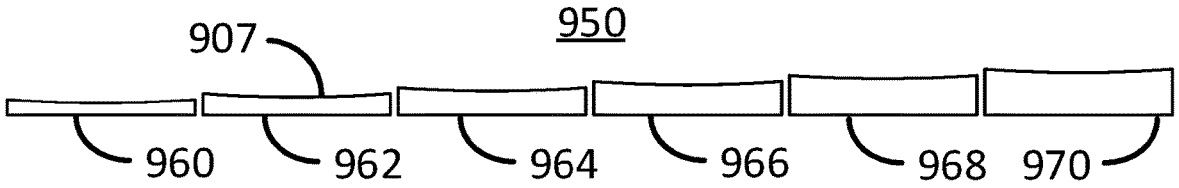
Figure 11G:
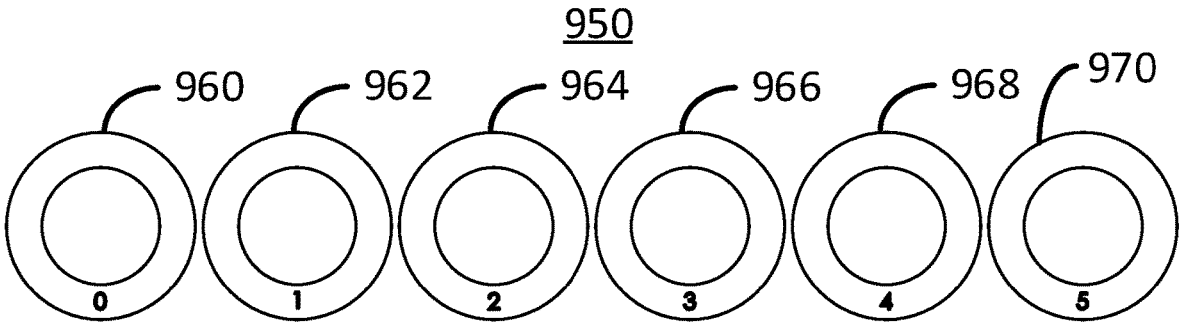

FIG. 11F illustratively depicts side views of multiple digital lift heights. Note that the profile of each digital lift ring has the concave arced lift ring profile 907. Certain embodiments envision each digital lift ring 0.05 inches in thickness, however the different thickness Z height is not limited by any particular value. For example, in one embodiment the lowest Z height lift ring "0" 960 is 0.05 inches wide, ring "1" 962 being 0.125 inches wide, ring "2" 964 being 0.20 inches wide, ring "3" 966 being 0.275 inches wide, ring "4" 968 being 0.35 inches wide, and ring "5" 970 being 0.425 inches wide. The term "wide" as used in conjunction with the lift rings 950 in this example is synonymous with the height in the Z direction. Of course, a skilled artisan after the benefit of understanding the present disclosure will appreciate that there could be far more sizes available for digital lift rings 950. FIG. 11G shows a top view of the different digital lift rings 950 depicted in FIG. 11F.

Certain embodiments contemplate any one or all of the adjusted elements can be used to establish a custom set of measurements. The custom set of measurements can then be used to create a one-piece mold, a multi-part mold, printed or machined part/s or some other physical model based on the specified measurements from the adjustable elements and processes discussed above. Some advantages of a custom measurement mold/s can include weight and the elimination of multiple parts, just to name several examples. Based on the indicia locations/measurements at each degree of freedom, it is envisioned that a custom post can be made to individualize the post for the physical attributes of the skater.

Figure 12A:
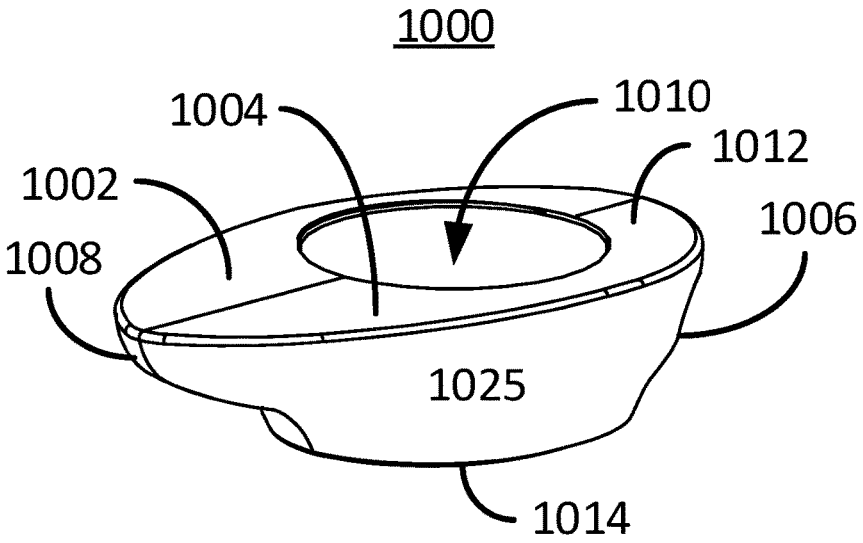
FIGS. 12A-12E illustratively depicts line drawings of a protective cup embodiment that protects the front and rear multi-degree of freedom arrangements 660 and 670 consistent with embodiments of the present invention.

FIGS. 12A-12E illustratively depicts line drawings of a protective cup embodiment that protects the front and rear multi-degree of freedom arrangements 660 and 670 consistent with embodiments of the present invention. FIG. 12A is an isometric drawing of a protective cup embodiment 1000 that is adapted and configured to protect the front and rear multi-degree of freedom arrangements 660 and 670 from the insults of the external environment (e.g., hockey pucks, hockey sticks, rough handling/bumping into things, etc.). In the present embodiment, two protective cup sides 1002 and 1004 clamp together to surround a significant portion of the front and rear multi-degree of freedom arrangements 660 and 670. As shown, the protective cup arrangement 1000 is defined by a cup front 1008, a cup rear 1006, a cup bottom surface 1014, and a cup top surface 1012. There is an upper accommodating multi-degree of freedom arrangement carve-out 1010 and a lower accommodating multi-degree of freedom arrangement carve-out 1011 that provide space for the front and rear multi-degree of freedom arrangements 660 and 670 to reside inside of the cup 1000. Certain embodiments envision the outer cup shell/surface 1025 made out of a rigid and resilient material such as metal, polymer, nylon, glass filled composite, carbon composite, or other material that can provide the appropriate qualities of the protective cup arrangement 1000.

Figure 12B:
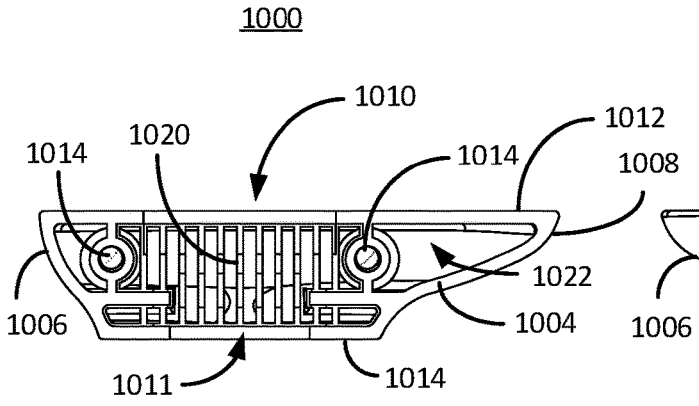
Figure 12C:
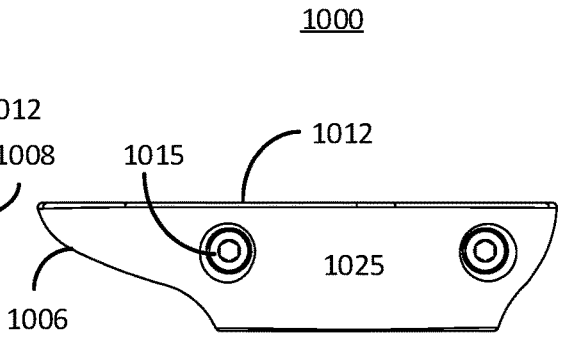

FIGS. 12B and 12C illustratively depicts side view line drawings of the right protective cup side 1004 consistent with embodiments of the present invention. As shown in FIG. 12B, the interior of the protective cup 1000 is mostly hollow 1022 but has locking grips 1020 arranged as ribs in the present embodiment. The locking grips 1020 surround and compress/conform to the front and rear multi-degree of freedom arrangements 660 and 670, and more specifically, the middle threaded ring 740 and the upper threaded ring 760, assuming the upper threaded ring 760 is used. In this way, the locking grips 1020 prevent the threaded rings 740 and 760 from spinning/turning and coming loose. Certain embodiments envision the locking grips 1020 being made of rubber, collapsible foam, collapsible metal, or other material that basically surrounds and locks the front and rear multi-degree of freedom arrangements 660 and 670 in place. In the present embodiment, there are two screw holes 1014 adapted and configured to receive threaded bolts or screws 1015. The threaded bolts or screws 1015 pull and clamp the two protective cup sides 1002 and 1004 together.

Figure 12D:
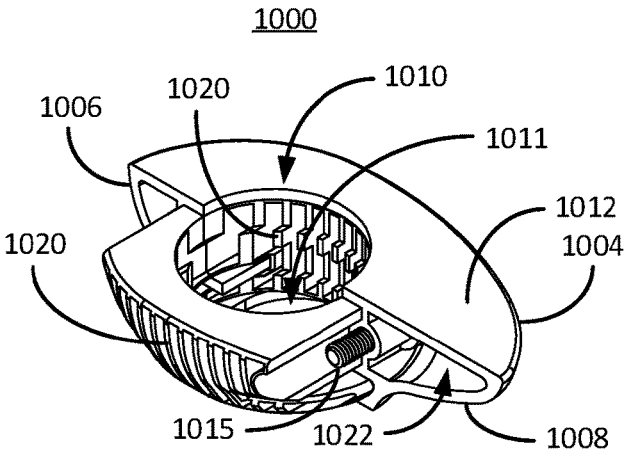

FIG. 12D illustratively depicts an isometric view line drawing of the right protective cup side 1004 with the entire internal locking grips 1020 consistent with embodiments of the present invention. As shown, the locking grips extend from the cup top surface 1012 to the cup bottom surface 1014, but provide a passageway for the front and rear multi-degree of freedom arrangements 660 and 670 shown via the upper carve-out 1010 and the lower carve-out 1011. Also shown for reference is the threaded bolt or screw 1015 that screws the two sides 1002 and 1004 together.

Figure 12E:
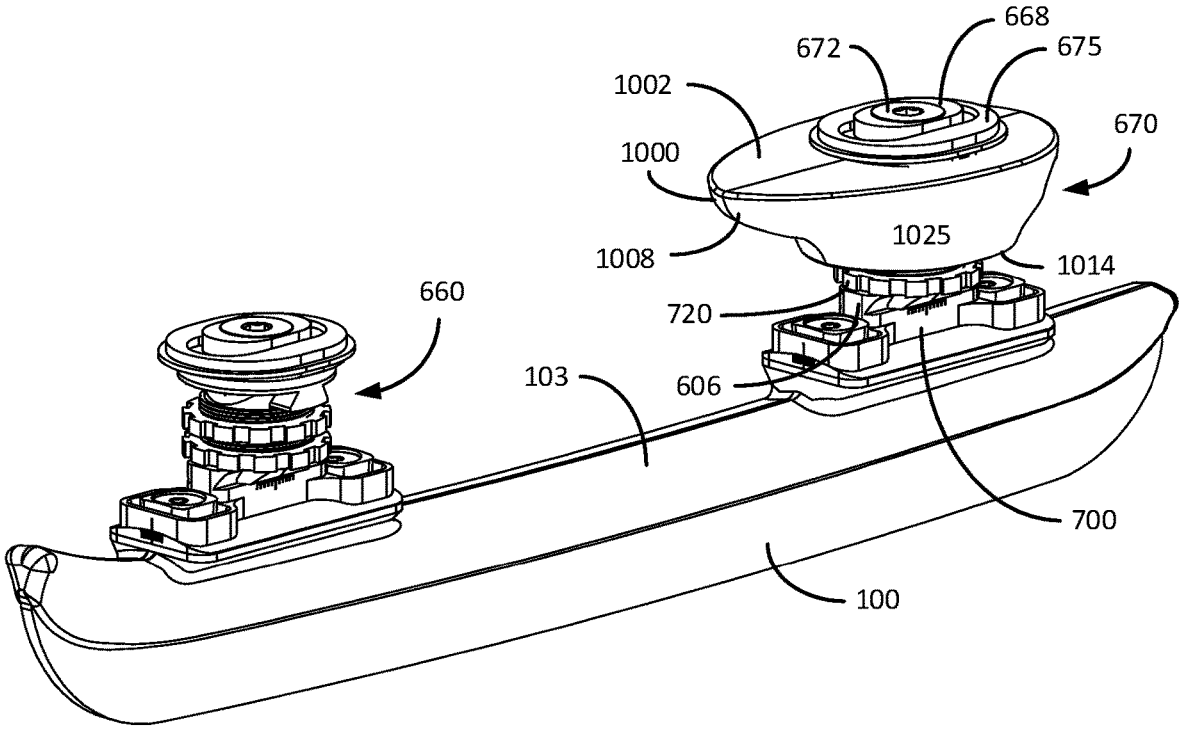

FIG. 12E illustratively depicts the cup arrangement 1000 engaged with the rear multi-degree of freedom arrangement 670 consistent with embodiments of the present invention. In the present embodiment, the cup arrangement 1000 is clamped around a portion of the rear multi-degree of freedom arrangement 670 without obstructing the rear attachment plate 675 or the lower threaded ring 720. It is self-evident that the rear attachment plate 675 needs clear axis for attaching to the ice skate sole 680 and is therefore uncovered. The lower threaded ring 720 is uncovered so that a person can loosen (by twisting) the lower threaded ring 722 facilitate quick release of the skate blade and runner assembly 100/103 by disengaging the fore/aft dovetail 606 with the fore/aft channel 724 as described earlier. A second cup arrangement is envisioned to cover the front multi-degree of freedom arrangement 660 similar to that shown for the rear multi-degree of freedom arrangement 670.

Certain embodiments of the present invention envision that:

Embodiment 1: A skate runner 100 comprising: an elongated skate runner body 103 that extends between a front end 190 and a rear end 192 defining a blade length 195; a bottom region 104 defining a bottom width 128 and a top region 118 defining a top width 126; a blade edge 101 located at the bottom region 104, the blade edge 101 is configured to contact an ice sheet 177, the blade edge 101 extending in a vertical direction 123 terminating at a blade top 121; a neutral plane defined along a central axis 314 centrally located in the bottom width 128 in the vertical direction and along the blade length 195; the top width 126 narrower than the bottom width 128; and a stress relieving radius 110 that joins the top region 118 to the bottom region 104, the skate runner 100 is a unitary structure.

Embodiment 2: The skate runner of embodiment 1 wherein the top region 118 is essentially encased in a polymeric overmold core 200 that extends in the vertical direction 123 beyond the blade top 121 terminating at an overmold core top 204.

Embodiment 3: The skate runner of embodiment 2 wherein the polymeric overmold core 200 is essentially encased in a skate overmold 300 that is essentially defined by an overmold top surface 310 and overmold side walls 308 which terminates at a blade/overmold interface 312, the overmold top surface 310 possessing a front mounting surface 302 and a rear mounting surface 304.

Embodiment 4: The skate runner of embodiment 3 wherein the skate overmold 300 is a different material than the skate over mold core 200.

Embodiment 5: The skate runner of embodiment 3 wherein the front mounting surface 302 and a rear mounting surface 304 further possess female interlocking mount receptacles 306.

Embodiment 6: The skate runner of embodiment 5 wherein the female interlocking mount receptacles 306 cooperate with male interlocking mounts 400A or 400B.

Embodiment 7: The skate runner of embodiment 5 wherein the female interlocking mount receptacles 306 cooperate with male interlocking mounts 400B that extend from a bottom side 418 of a mounting plate 405, the mounting plate 405 comprising an arced mounting surface on a top side 414.

Embodiment 8: The skate runner of embodiment 7 wherein each of the mounting plates 405 and the male interlocking mounts 400B are unitary.

Embodiment 9: The skate runner of embodiment 8 wherein each of the arced mounting plates 405 possesses pronate/supinate graduated indicia 416 visibly disposed on at least a front surface 410.

Embodiment 10: The skate runner of embodiment 7 wherein each of the mounting plates 405 possess tapped holes 412 adapted to receive threaded male fasteners.

Embodiment 11: The skate runner of embodiment 3 wherein the front mounting surface 302 and a rear mounting surface 304 are each removably connected with a mounting plate 405.

Embodiment 12: The skate runner of embodiment 11 wherein each of the mounting plates 400 possess a convex arc cylinder segment 405 that arcs around a contact axis 650 defined by a rocker high point 113 of the blade edge 101 and the neutral plane 315.

Embodiment 13: The skate runner of embodiment 12 further comprising a pronate/supinate platform 600 that possesses a concave arc 609 that mates with the convex arc cylinder segment 405.

Embodiment 14: The skate runner of embodiment 13 further comprising pronate/supinate graduations 416 visibly located on at least a front surface 410 of the mounting plates 400 that cooperate with a pronate/supinate centerline pointer 611 on the pronate/supinate platform 600.

Embodiment 15: The skate runner of embodiment 13 wherein the pronate/supinate platform 600 is adjustably attached to the convex arc cylinder segment 405.

Embodiment 16: The skate runner of embodiment 15 wherein the pronate/supinate platform 600 is adjustably rotated about the contact axis 650 in a pronation position 635 or a supination position 645.

Embodiment 17: The skate runner of embodiment 16 further comprising fore/aft graduated indicia 616 visibly disposed on at least one pronate/supinate platform side surface 619 below a fore/aft dovetail 606 extending along a top portion of the pronate/supinate platform 600.

Embodiment 18: The skate runner of embodiment 13 further comprising a fore/aft dovetail 606 extending longitudinally parallel to the contact axis 650 along a pronate/supinate platform top surface 613 obverse to the concave arc 609.

Embodiment 19: The skate runner of embodiment 18 further comprising a bi-directional locking dovetail module 700 that includes: a threaded cylinder A 702; a fore/aft dovetail channel 706 extending from bottom side A 714 of the threaded cylinder A 702 that slidingly engages the fore/aft dovetail 606 parallel to the contact axis 650; and a side/side dovetail channel 724 extending from a threaded cylinder A top side 716 that extends essentially perpendicular to the contact axis 650.

Embodiment 20: The skate runner of embodiment 19 further comprising a threaded ring A 720 that is rotatingly engaged with threads A 701 on the threaded cylinder A 702.

Embodiment 21: The skate runner of embodiment 20 wherein the threaded ring A 720 is in a locking position when the threaded ring A 720 is in contact compression with the pronate/supinate platform top surface 613, the fore/aft dovetail 606 is in compression with the fore/aft dovetail channel 706; the threaded ring A 720 is in an unlocking position when the threaded ring A 720 is not in the contact compression with the fore/aft dovetail 606.

Embodiment 22: The skate runner of embodiment 20 wherein the threaded ring A 720 possess grips 722.

Embodiment 23: The skate runner of embodiment 13 wherein the fore/aft dovetail can be disconnected from the fore/aft dovetail channel 706 by loosening the threaded ring A 720.

Embodiment 24: The skate runner of embodiment 21 further comprising a centerline pointer B 711 visibly located on the fore/aft dovetail channel 706, the centerline pointer B 711 cooperates with the fore/aft graduated indicia 616.

Embodiment 25: The skate runner of embodiment 21 further comprising a centerline pointer C 712 visibly located on the side/side dovetail channel 724.

Embodiment 26: The skate runner of embodiment 19 further comprising a side/side dovetail module 800 that includes a side/side dovetail 804 extending from a bottom side B 814 of a threaded cylinder B 802, threaded cylinder B 802 possesses threads B 801 on the threaded cylinder B 802, the side/side dovetail B 804 slidingly engages the side/side dovetail channel 724 that is essentially perpendicular to the contact axis 650.

Embodiment 27: The skate runner of embodiment 24 further comprising a threaded ring B 740 that is rotatingly engaged with threads A 701 on the threaded cylinder A 702.

Embodiment 28: The skate runner of embodiment 27 wherein the threaded ring B 740 is in a locking position when the threaded ring B 740 is in contact compression with the side/side dovetail 804 the side/side dovetail 804 is in compression with the side/side dovetail channel 724; the threaded ring B 740 is in an unlocking position when the threaded ring B 740 is not in the contact compression with the side/side dovetail 804.

Embodiment 29: The skate runner of embodiment 28 wherein the threaded cylinder B 802 possesses at least one lift ring orientation recess 818 that extends into the cylinder surface B 803 between the bottom side B 814 to a cylinder B top surface 816 of the threaded cylinder B 802.

Embodiment 30: The skate runner of embodiment 29 wherein the at least one lift ring orientation recess 818 is either a channel or a flat.

Embodiment 31: The skate runner of embodiment 30 further comprising a plate 826 interposed between the side/side dovetail 804 and the bottom cylinder side B 814, the plate 826 defining a plate surface 825 from which the side/side dovetail 804 extends, side/side graduated indicia 828 visibly located on the plate surface 825, the side/side graduated indicia 828 cooperating with the centerline pointer C 712.

Embodiment 32: The skate runner of embodiment 29 further comprising a lift ring 900 that encircles the threaded cylinder B 802, the lift ring 900 possessing at least one lift ring alignment key 906 that engages the at least one lift ring orientation recess 818 in a limited rotating relationship.

Embodiment 33: The skate runner of embodiment 32 wherein the limited rotating relationship provides up to 20 degrees of rotation between the lift ring 900 and the threaded cylinder B 802.

Embodiment 34: The skate runner of embodiment 32 wherein the lift ring 900 terminates at a lift ring top surface 902 that when engaged with the threaded cylinder B 802 is above the cylinder B top surface 816.

Embodiment 35: The skate runner of embodiment 32 wherein the lift ring 900 terminates at a lift ring top surface 902 that when engaged with the threaded cylinder B 802 is above the cylinder B top surface 816.

Embodiment 36: The skate runner of embodiment 34 wherein lift ring top surface 902 is concave with a low point 907 essentially in line with the side/side dovetail 804.

Embodiment 37: The skate runner of embodiment 32 further comprising a threaded ring C 760 rotationally engaged with the threaded cylinder B 802, the lift ring 900 rests on the threaded ring C 760.

Embodiment 38: The skate runner of embodiment 37 wherein the lift ring 900 is in a low position 930 on the threaded cylinder B 802 when the ring C 760 is disposed essentially at the bottom side B 814 of the threaded cylinder B 802 and the lift ring 900 is in a high position 940 on the threaded cylinder B 802 when the ring C 760 is disposed essentially at the cylinder B top surface 816 of the threaded cylinder B 802.

Embodiment 39: The skate runner of embodiment 34 further comprising an attachment plate 665/675 that possess a convex surface that conforms to the concave lift ring top surface 902, the attachment plate 665/675 configured to attach to a sole 680 of an ice skate boot 699.

Embodiment 40: The skate runner of embodiment 39 further comprising a washer 668 that fits in an accommodating washer recess 666 in the convex surface of the attachment plate 665/675, the washer 668 receives a threaded bolt 672 that screws into a threaded/tapped hole B 825 in the side/side dovetail module 800, the threaded bolt 672 secures the washer 668, the attachment plate 665/675 and the lift ring 900 to the side/side dovetail module 800.

Embodiment 41: The skate runner of embodiment 40 wherein the threaded bolt 672 attaches a boot sole to the side/side dovetail module 800, the boot sole interposed between a bolt head of the threaded bolt.

Embodiment 42: The skate runner of embodiment 37 wherein the threaded ring A 720, the threaded ring B 740 and the threaded ring C 820 possess grips 722.

The embodiment list (the enumerated embodiments) is not exhaustive of the embodiments presented throughout the description, but rather are merely one example of a contemplated embodiment chain consistent with embodiments of the present invention. In other words, there are numerous other embodiments describe herein that are not in the embodiment list.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended embodiments are expressed. For example, each element can stand alone to adjust solely for the degree of freedom desired without departing from the scope and spirit of the present invention. Likewise, less than all of the adjustable components can be combined to provide several degrees of freedom presented within this disclosure while still maintaining substantially the same functionality without departing from the scope and spirit of the present invention. Moreover, other mechanical elements can be implemented to accomplish the degree of freedom adjustments presented within this disclosure while still maintaining substantially the same functionality without departing from the scope and spirit of the present invention. Another example can include using other mechanical arrangements that fulfill the same functionality as dovetails and cooperating channels without departing from the scope and spirit of the present invention. Furthermore, embodiments envision the dovetail channels essentially being replaced with dovetails and the dovetails being replaced with the dovetail channels so long as their mating relationships remain intact. The threaded cylinders and threaded rings can be used on either side of the dovetail channels/dovetail relationships. These inversions maintain the same functionality without departing from the scope and spirit of the present invention. Finally, although the preferred embodiments described herein are directed to hockey skates, it will be appreciated by those skilled in the art that the teachings of the present invention can be applied to other systems (such as figure skates, roller blades and speed skates, for example), without departing from the spirit and scope of the present invention.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed and as defined in the appended claims.

What is claimed is:

1. A skate post quick release arrangement comprising:

an elongated male mounting bar that slidingly cooperates with a female channel;

a threaded cylinder either connected to the elongated male mounting bar or the female channel;

a threaded ring mating with the threaded cylinder, the threaded ring configured to move along the threaded cylinder when rotated about the threaded cylinder, the elongated male mounting bar and the female channel locked in a compressed relationship when the threaded ring is in a tightened position, the elongated male mounting bar and the female channel unlocked in a non-compressed relationship when the threaded ring is in a loosened position, the skate post quick release arrangement possessing a first end configured to attach to a skate overmold that essentially encapsulates an elongated skate runner, and the skate post quick release arrangement possessing a second end configured to attach to an ice-skating boot sole.

2. The skate post quick release arrangement of claim 1 wherein the elongated male mounting bar and the female channel extend lengthwise along the elongated skate runner, the skate runner defined by an elongated skate runner body further defining a length that extends between a front end and a rear end.

3. The skate post quick release arrangement of claim 2 wherein skate post quick release arrangement is configured to attach to the skate overmold towards the front end and a second skate post quick release arrangement is configured to attach to the skate overmold towards the rear end.

4. The skate post quick release arrangement of claim 3 wherein when the two skate post quick release arrangements are in the loose position, the skate overmold is capable of being detached from the ice-skating boot sole.

5. The skate post quick release arrangement of claim 1 wherein when in the tightened position, the threaded ring is compressed against a top surface of the elongated male mounting bar, in addition the elongated male mounting bar and the female channel are in contact compression, the threaded ring is connected with the female channel as a unitary element.

6. The skate post quick release arrangement of claim 1 wherein the elongated male mounting bar is a dovetail and the female channel is a dovetail channel, the dovetail adapted to slide axially through the dovetail channel.

7. The skate post quick release arrangement of claim 1 further comprising fore/aft graduated indicia visibly disposed along the elongated male mounting bar where the fore/aft graduated indicia is not obstructed by the female channel.

8. The skate post quick release arrangement of claim 7 further comprising a fore/aft pointer visibly disposed on an outside portion of the female channel, the fore/aft pointer aligning with at least one of the fore/aft graduated indicia when the elongated male mounting bar is engaged with the female channel.

9. A bi-directional cylinder arrangement comprising:

a threaded cylinder possessing screw threads;

an upper threaded ring and the lower threaded ring matingly engaged with the screw threads;

a pair of fore/aft channel walls extending from a bottom side of the threaded cylinder, the fore/aft channel walls defining a fore/aft channel;

a pair of side/side channel walls extending from a top side of the threaded cylinder, the side/side channel walls defining a side/side channel, the fore/aft channel is essentially offset from the side/side channel by 90°, the side/side channel slidingly engaged with a side/side bar, the side/side bar extending from an ice-skating sole connecting post configured to connect to an ice-skating sole, and the fore/aft channel configured to slidingly connect with a fore/aft bar extending from an ice skate blade system.

10. The bi-directional cylinder arrangement of claim 9 wherein the fore/aft channel is a fore/aft dovetail channel and the side/side channel is a side/side dovetail channel.

11. The bi-directional cylinder arrangement of claim 9 wherein the side/side bar is in a tightened relationship with the side/side channel when the upper threaded ring is compressively tightened against a confronting side/side bar surface of the side/side bar, the side/side bar is immobily fixed with the side/side channel while in the tightened relationship.

12. The bi-directional cylinder arrangement of claim 9 wherein the side/side bar is in a loosened relationship with the side/side channel when the upper threaded ring is not compressively tightened against the side/side bar, the side/side bar is movable in a side-by-side motion within the side/side channel when in the loosened relationship.

13. The bi-directional cylinder arrangement of claim 9 wherein the ice-skating sole connecting post possesses a lift ring that extends a distance between an attachment point on the connecting post and the ice-skating sole.

14. The bi-directional cylinder arrangement of claim 9 wherein the connecting post possesses post screw threads that extend between a top portion of the connecting post and a bottom portion of the connecting post, the post screw threads cooperate with a post threaded ring in a rotating relationship, when the post threaded ring is approximately at the low portion, a first distance between the top portion and the ice-skating sole is smaller than a second distance between the top portion and the ice-skating sole when the post threaded ring is approximately at the high portion.

* * * * *